US007154525B2

(12) United States Patent
Oda et al.

(10) Patent No.: US 7,154,525 B2
(45) Date of Patent: Dec. 26, 2006

(54) METHOD AND DEVICE FOR FOCUS ADJUSTMENT OF OPTICAL WRITING UNIT AND IMAGE FORMING APPARATUS INCORPORATING THE FOCUS ADJUSTMENT DEVICE

(75) Inventors: Ayumu Oda, Nara (JP); Kyosuke Taka, Nara (JP); Takaharu Motoyama, Kashihara (JP); Norio Tomita, Yamatokoriyama (JP); Shohichi Fukutome, Nara (JP); Nobuo Manabe, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 283 days.

(21) Appl. No.: 10/600,850

(22) Filed: Jun. 20, 2003

(65) Prior Publication Data

US 2004/0008333 A1 Jan. 15, 2004

(30) Foreign Application Priority Data

Jun. 26, 2002 (JP) ..... P2002-186531
Jun. 26, 2002 (JP) ..... P2002-186532

(51) Int. Cl.
*B41J 27/00* (2006.01)

(52) U.S. Cl. ..... 347/241; 347/256

(58) Field of Classification Search ..... 347/133, 347/236–241, 246, 247, 234–235, 248, 250–256, 347/116, 244, 258; 358/3.29; 250/201.5, 250/201.2, 201.6–201.8, 204; 396/89; 359/383–384
See application file for complete search history.

(56) References Cited

U.S. PATENT DOCUMENTS 5,231,280 A * 7/1993 Imakawa ..... 250/201.5
6,061,526 A * 5/2000 Deguchi et al. ..... 396/89
6,181,356 B1 * 1/2001 Ohnishi et al. ..... 347/116
6,288,733 B1 * 9/2001 Nakazawa et al. ..... 347/133
6,842,188 B1 * 1/2005 Iannazzi ..... 347/241
2002/0196473 A1 * 12/2002 Patten et al. ..... 358/3.29

FOREIGN PATENT DOCUMENTS

JP 62-166372 7/1987
JP 07-270673 10/1995

* cited by examiner

*Primary Examiner*—Hai Pham
(74) *Attorney, Agent, or Firm*—David G. Conlin; David A. Tucker; Edwards Angell Palmer & Dodge LLP

(57) ABSTRACT

Focus adjustment of an optical writing unit is performed based on an image of a test pattern formed on a paper sheet. The pattern includes bars of density levels associated with adjustment quantity information indicating numerical values corresponding to the numbers of rotation of adjustment motors and adjustment screws. The density levels decrease as the amount of displacement of the unit with respect to a photosensitive drum increases. A focus adjustment device accepts an input of the numerical values indicated beside the unprinted bars of the lowest density levels and causes the motors to turn by the numbers of rotation indicated by the input numerical values to move the unit to the position of correct focus. It is possible to perform focus adjustment of the unit with ease and high accuracy regardless of whether the unit is for forming binary or multi-valued images.

18 Claims, 19 Drawing Sheets

METHOD AND DEVICE FOR FOCUS ADJUSTMENT OF OPTICAL WRITING UNIT AND IMAGE FORMING APPARATUS INCORPORATING THE FOCUS ADJUSTMENT DEVICE

BACKGROUND OF THE INVENTION

1. Field of the Invention

The present invention relates to a method and a device for focus adjustment of an optical writing unit which performs electrophotographic image forming operation, in which an electrostatic latent image is formed on a surface of an image carrying member by projecting light modulated by image data onto the image carrying member. The invention also relates to an image forming apparatus incorporating such a focus adjustment device.

2. Description of the Related Art

An image forming apparatus, such as a copying machine or a laser printer, for performing electrophotographic image forming operation forms an electrostatic latent image on a surface of an image-carrying member (photosensitive drum) by projecting light modulated by digitized image data from light-emitting elements of an optical writing unit, develops a visible image from the latent image by means of toner particles, and transfers the visible image onto a printing medium such as a sheet of blank paper. Optical writing units used in such image forming apparatuses are classified into two types: a laser scanning type and a solid-state light source scanning type.

An optical system of the laser scanning type optical writing unit needs to have a long light path since it deflects a light beam emitted from a single laser light-emitting device over a wide scanning angle by means of a spinning polygon mirror, for example. This structure makes it difficult to reduce the size and cost of the image forming apparatus employing the laser scanning type optical writing unit.

On the other hand, the solid-state light source scanning type optical writing unit employs an array of light-emitting elements, such as light-emitting diodes (LEDs) or electroluminescent (EL) segments, and an array of lenses, such as selfoc (self-focusing) lenses, for converging light emitted from the light-emitting elements and projecting the converged light onto a surface of an image-carrying member. To form an A3 size image at a resolution of 600 dots per inch (dpi), for example, the number of the light-emitting elements to be arranged in a line is approximately 7000. In the solid-state light source scanning type optical writing unit, each of the light-emitting elements is used to write one pixel on the image-carrying member, so that the light path length of its optical system can be shortened, making it possible to reduce the size and cost of the image forming apparatus. Accordingly, the solid-state light source scanning type is an industrial mainstream of the optical writing units in recent years.

In the solid-state light source scanning type optical writing unit, too short a light path length is likely to decrease the depth of focus, resulting in loss of focus. This defocusing problem can be solved by precisely adjusting the distance between the optical writing unit and the image-carrying member. Therefore, a worker in an image forming apparatus assembly line visually examines printed images and manually adjusts the distance between the optical writing unit and the image-carrying member repeatedly on a trial-and-error basis.

Adjustment of the distance between the optical writing unit and the image-carrying member performed by manual operation in this fashion is fairly complicated and difficult, requiring skilled workers and long work time.

A conventional technique related to this kind of focus adjustment procedure is disclosed in Japanese Laid-open Patent Publication No. S62-166372. According to the disclosure, an image is first formed with an optical writing unit held at a specific slant angle with respect to an image-carrying member so that the focal length varies along an array of light-emitting elements and, after displacing the optical writing unit parallel to its original position without changing its slant angle, an image is formed again. Then, the slant angle of the optical writing unit with respect to the image-carrying member and the amounts of offset of the focal length are calculated from information on the positions of two pixels best focused in the two successive image forming processes.

Japanese Laid-open Patent Publication No. H7-270673 discloses another conventional technique, in which image patterns are formed while varying the focal length and repeatedly turning on and off an optical writing unit whereby the optical writing unit is set to a position where an image of the lowest density is obtained.

However, the technique disclosed in Japanese Laid-open Patent Publication No. S62-166372 involves the need to perform a complex mathematical operation for focus adjustment. Also, Japanese Laid-open Patent Publication No. H7-270673 is intended for use in an apparatus employing an image-carrying member for producing a binary (black and white) image and there is no mention of a focus adjustment technique for an image-carrying member for multi-valued image forming applications.

SUMMARY OF THE INVENTION

It is an object of the invention to provide a focus adjustment method and a focus adjustment device which make it possible to perform focus adjustment of an optical writing unit with respect to an image-carrying member with ease and high accuracy regardless of whether the optical writing unit is for forming binary or multi-valued images. It is a further object of the invention to provide an image forming apparatus incorporating such a focus adjustment device.

According to the invention, a focus adjustment method for an optical writing unit includes a pattern image forming process for forming a test pattern including multiple pattern elements (bars) of varying density levels corresponding to different amounts of adjustment by projecting light modulated by image data of the test pattern from an array of multiple light-emitting elements corresponding to pixels arranged along a main scanning direction over an image forming area onto a surface of an image-carrying member, converting an electrostatic latent image formed on the surface of the image-carrying member into a visible toner image, and transferring the toner image from the surface of the image-carrying member onto a printing medium, and a position adjustment process for adjusting the position of the optical writing unit relative to the surface of the image-carrying member by the amount of adjustment indicated by the density levels of the multiple bars of the test pattern formed on the printing medium.

In this focus adjustment method, the test pattern including the multiple bars of varying density levels corresponding to different amounts of adjustment is formed on a printing medium, and the position of the optical writing unit is adjusted relative to the surface of the image-carrying member by the amount of adjustment indicated by the density levels of the multiple bars formed on the printing medium.

If the focal point of the optical writing unit does not coincide with the surface of the image-carrying member, the density levels of the individual bars of the test pattern decrease due to loss of focus. The density levels of the bars gradually decrease and the bars become eventually invisible (unprinted) in the order of the lowest to highest density ones as the amount of focus adjustment error increases. Thus, the amount of adjustment of the optical writing unit for bringing it to the position of correct focus with respect to the surface of the image-carrying member can be easily determined by checking out the density levels of the unprinted bars on the printing medium, thereby facilitating operation for focus adjustment of the optical writing unit.

These and other objects will become more readily apparent from the following detailed description and accompanying drawings.

DETAILED DESCRIPTION OF THE PREFERRED EMBODIMENTS OF THE INVENTION

Figure 1:
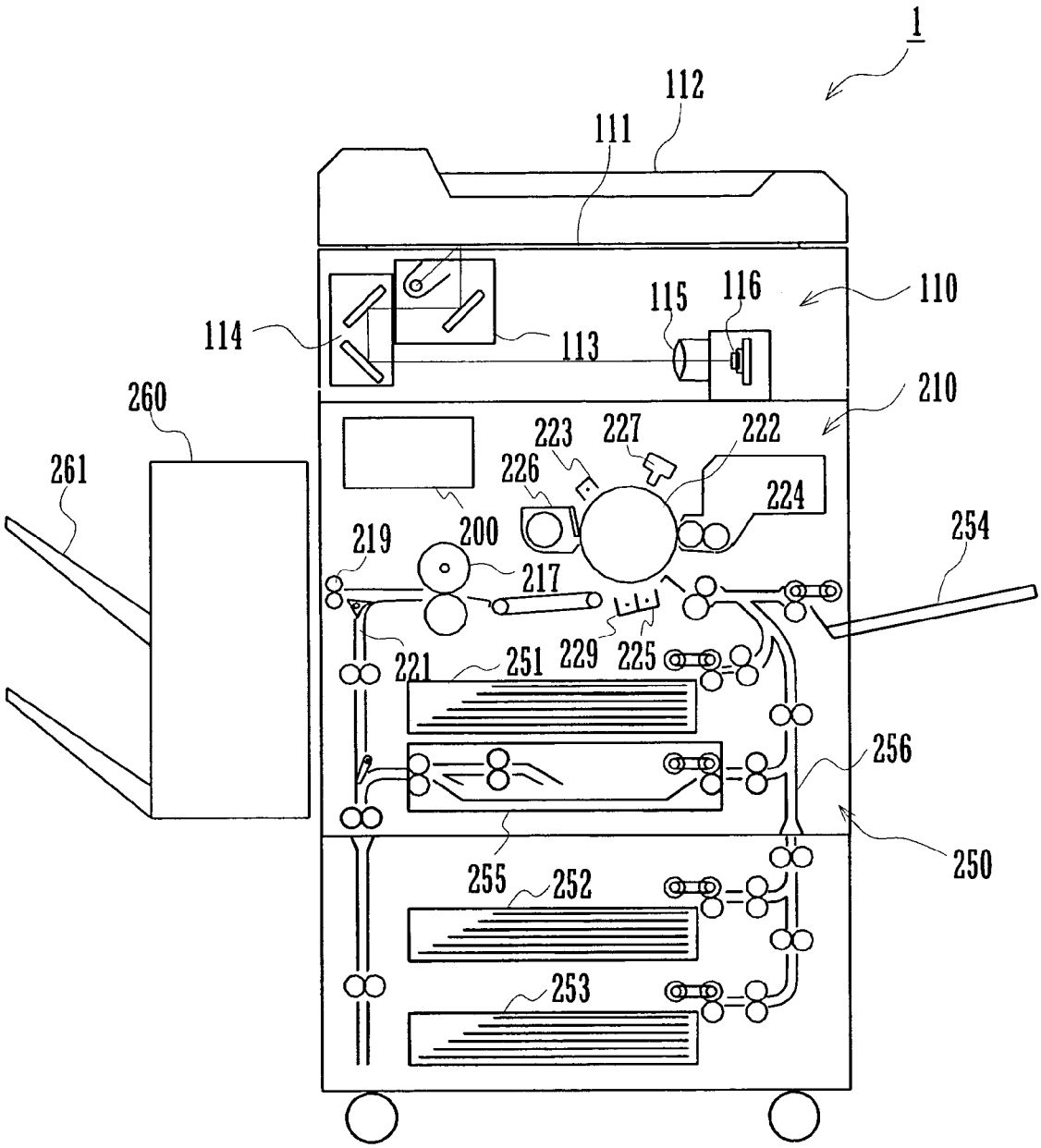
FIG. 1 is a diagram showing the construction of a digital image forming apparatus comprising an optical writing unit associated with a focus adjustment device using a focus adjustment method according to an embodiment of the invention.

FIG. 1 is a diagram showing the construction of a digital image forming apparatus 1 comprising an optical writing unit associated with a focus adjustment device using a focus adjustment method according to an embodiment of the invention. There is provided transparent platen glass 111 at the top of the digital image forming apparatus 1. An automatic document feeder (ADF) 112 is normally positioned on top of the platen glass 111. The ADF 112 which can be swung up and down to expose and cover a top surface of the platen glass 111 automatically feeds one sheet after another of an original document placed on an original tray onto the platen glass 111.

There is provided an image reading section 110 inside the digital image forming apparatus 1 beneath the platen glass 111. The image reading section 110 is built up of a first scanning unit 113, a second scanning unit 114, an optical lens 115 and a photoelectric converter device 116, such as a charge-coupled device (CCD line sensor). The first scanning unit 113 includes a lamp unit for illuminating an original image and a first mirror for reflecting reflected light from the original image in a specific direction. The second scanning unit 114 includes a second and third mirrors for guiding the reflected light from the original image which has been reflected by the first mirror to the CCD line sensor 116. The optical lens 115 focuses the reflected light from the original image on a sensitive surface of the CCD line sensor 116. The image reading section 110 corresponds to the image reader mentioned in the appended claims. Working in coordinated action with the ADF 112, the image reading section 110 scans the original which has been transported by the ADF 112 to a specific exposure position on the platen glass 111.

The original image picked up by the image reading section 110 is sent as image data to an image processing section (not shown) and the image data which has undergone a specific image processing operation is stored in a memory (not shown). The image data stored in the memory is then transferred to an LED head 227, which is an solid-state light source scanning type optical writing unit built in an image forming section 210, according to an output command fed from a controller 200.

The LED head 227 receives the image data once stored in the memory or image data transferred from an external apparatus according to instructions of the controller 200. The LED head 227 includes an array of light-emitting elements (LEDs) 11 which illuminate in accordance with the incoming image data and an array 13 of lenses, such as selfoc lenses, for focusing light emitted from the light-emitting element array on a photosensitive drum 222 serving as an image-carrying member. The LED head 227 thus constructed exposes a sensitive surface of the photosensitive drum 222, which has been uniformly charged to a specific potential by a later-described charging unit 223, to the light modulated by the image data, thereby forming an electrostatic latent image on the surface of the photosensitive drum 222.

The image forming section 210 includes the charging unit 223, the LED head 227, a developing unit 224, a toner transfer unit 225, a discharging unit 229 and a cleaning unit 226 which are arranged in this order along a drum rotating direction around the photosensitive drum 222. The charging unit 223 charges the surface of the photosensitive drum 222 to the specific potential and the developing unit 224 transfers toner particles onto charged surface areas of the photosensitive drum 222 to convert the latent image into a visible toner image. The toner transfer unit 225 transfers the toner image formed on the surface of the photosensitive drum 222 onto a sheet of paper. The toner transfer unit 225 may be of any conventional type, such as a charger type (shown in FIG. 1), roller type or brush type. The discharging unit 229 discharges the paper so that it can be easily peeled off the surface of the photosensitive drum 222. The cleaning unit 226 removes and collect residual toner particles from the surface of the photosensitive drum 222.

The sheet of paper carrying the toner image transferred in the image forming section 210 is conveyed to a fixing unit 217 which applies heat and pressure to fuse and securely fix the toner image onto the paper.

In the digital image forming apparatus 1 of the embodiment, provided downstream of the image forming section 210 along its paper transport direction are, in addition to the fixing unit 217, a switchback paper transfer path 221 for guiding the paper to a paper reversing unit 255, in which the paper is introduced with its leading edge and trailing edge reversed for producing a double-sided print, and an after-treatment unit 260 including an after-treatment mechanism for stapling sheets carrying printed original images and elevator trays 261 which move up and down according to the numbers of sheets output onto themselves. The sheet carrying the toner image fixed on one side by the fixing unit 217 is selectively routed through the switchback paper transfer path 221 and the developing unit 224 back to the image forming section 210 and the fixing unit 217 to produce a double-sided print as necessary. The sheet is then ejected by discharge rollers 219 onto one of the elevator trays 261 after going through specified after-treatment.

Also provided in the digital image forming apparatus 1 is a paper feed section 250 located beneath the image forming section 210. The paper feed section 250 includes a manual feed tray 254, the aforementioned paper reversing unit 255, paper trays 251–253 and a paper transfer path 256 for transporting each sheet of paper fed from any of the paper trays 251–253 or the paper reversing unit 255 into the image forming section 210. The paper reversing unit 255 temporarily holds a sheet of paper of which leading edge and trailing edge as well as printed and unprinted sides have been reversed in the switchback paper transfer path 221. The paper reversing unit 255 is made interchangeable with any of the ordinary paper trays 251–253.

Figure 2:
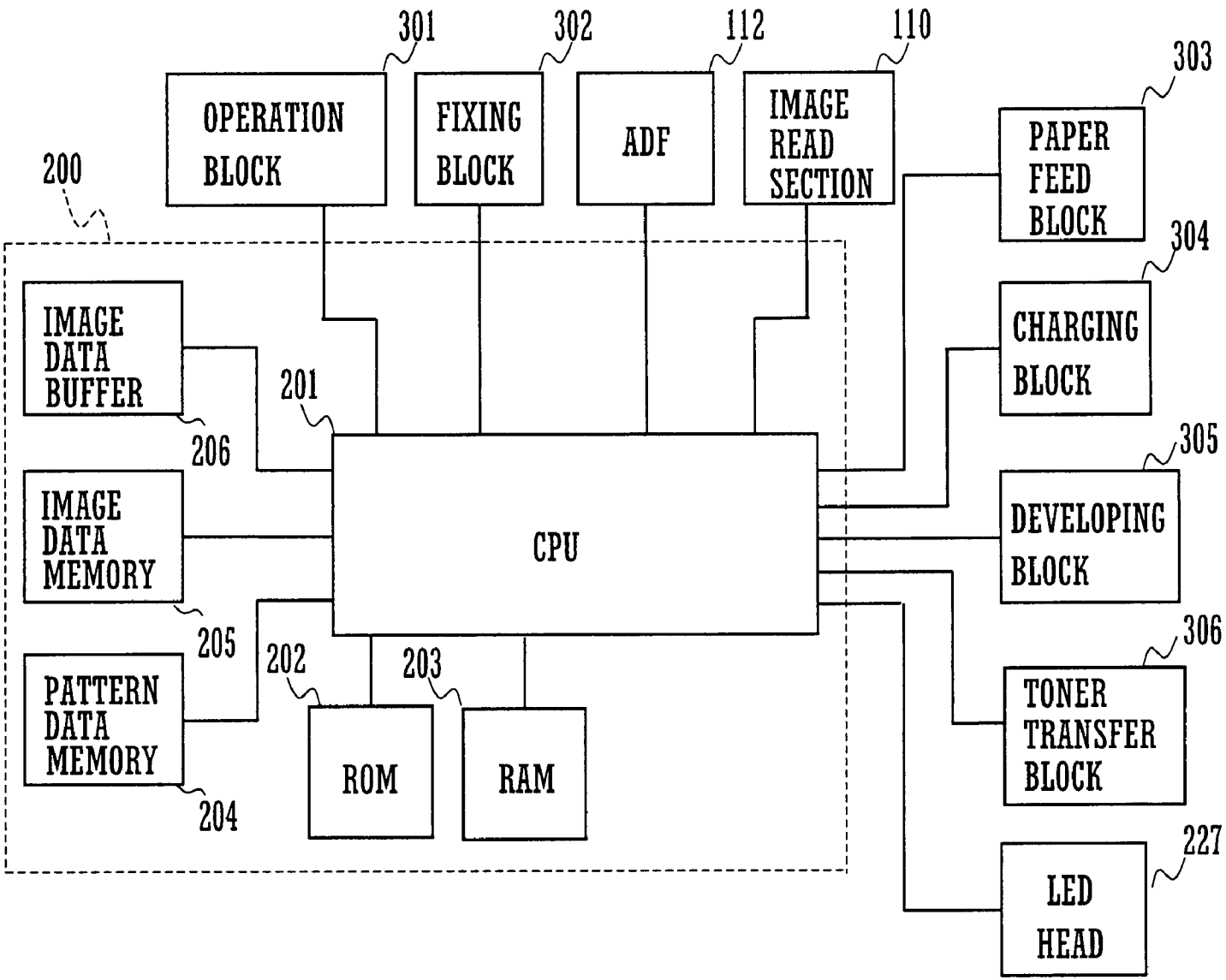
FIG. 2 is a block diagram showing the configuration of a controller of the digital image forming apparatus incorporating the focus adjustment method of the invention.

FIG. 2 is a block diagram showing the configuration of the controller 200 of the digital image forming apparatus. The controller 200 includes a central processing unit (CPU) 201 to which a read-only memory (ROM) 202, a random-access memory (RAM) 203, a pattern data memory 204, an image data memory 205 and an image data buffer 206 are connected. Also connected to the CPU 201 are such input/output and other peripheral units as an operation block 301, a fixing block 302, a paper feed block 303, a charging block 304, a developing block 305, a toner transfer block 306, the LED head 227, the ADF 112 and the image reading section 110. The CPU 201 undertakes overall control of these input/output and peripheral units in accordance with a program previously written in the ROM 202. Various data input and output in performing control operation are temporarily stored in the RAM 203.

The pattern data memory 204 is storage means for storing data on an image of a later-described test pattern. The image data memory 205 stores image data which has undergone the image processing operation. The image data buffer 206 receives image data from an external apparatus such as an image scanner. The operation block 301 controls display on an operating panel (not shown) in accordance with display data fed from the CPU 201 and delivers data on key operations entered by an operator through the operating panel to the CPU 201. The fixing block 302 supplies electric power to a heater of the fixing unit 217 in accordance with control data fed from the CPU 201.

The paper feed block 303 actuates motors and clutches for supplying turning forces to paper feed rollers provided to the trays 251–254 or the paper reversing unit 255 and to transport rollers in the paper transfer path 256 in accordance with control data fed from the CPU 201. The charging block 304 supplies electric power to a power supply of the charging unit 223 in accordance with control data fed from the CPU 201. The developing block 305 supplies electric power to a developing bias power supply and a driving motor of the developing unit 224 in accordance with control data fed from the CPU 201. Also, the toner transfer block 306 supplies electric power to a power supply of the toner transfer unit 225 in accordance with control data fed from the CPU 201.

Figure 3:
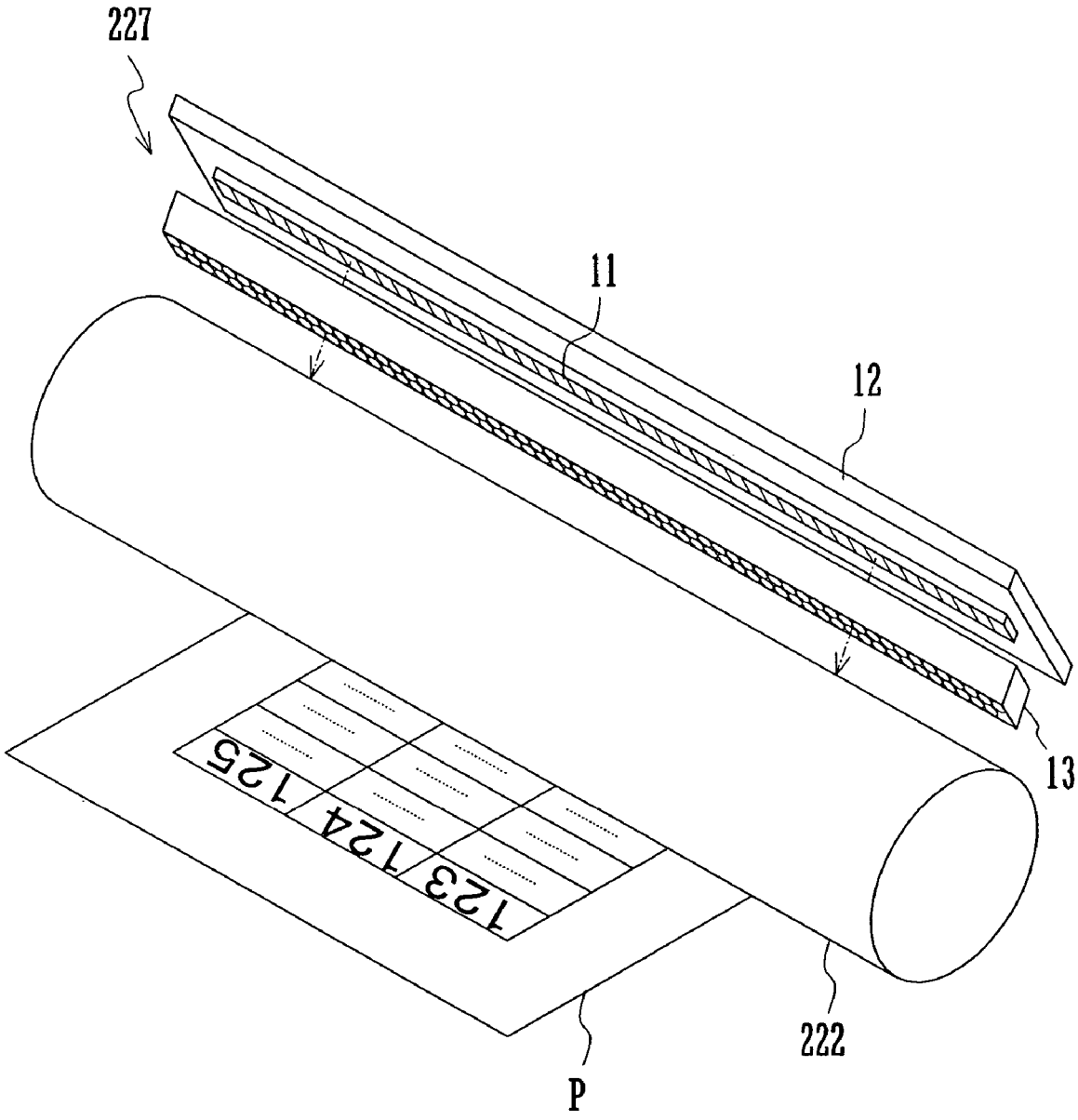
FIG. 3 is a diagram showing the positional relationship of a photosensitive drum and the an LED head of the digital image forming apparatus.

FIG. 3 is a diagram showing the positional relationship of the photosensitive drum 222 and the LED head 227. The LED head 227 is provided with an LED array board 12 and the aforementioned lens array 13. The multiple LEDs 11 are arranged in a linear array on the LED array board 12. This array of the LEDs 11 extends parallel to the longitudinal direction (main scanning direction) of the photosensitive drum 222 to cover generally the entire extent of the surface area of the photosensitive drum 222 along its rotational axis. The individual LEDs 11 correspond to pixels of an image to be formed on the surface of the photosensitive drum 222 along its main scanning direction and printed on a sheet of paper P. The lens array 13 is made up of the aforementioned multiple lenses which are arranged face to face with the individual LEDs 11.

With the LED head 227 positioned at a proper distance from the surface of the photosensitive drum 222, the LEDs 11 emit light in accordance with the image data entered and this light is focused by the lens array 13 onto the surface of the photosensitive drum 222. It is therefore necessary to install the LED head 227 in the digital image forming apparatus 1 in such a way that the LED head 227 is positioned at the proper distance from the surface of the photosensitive drum 222 all along the main scanning direction in order to reproduce the original image on the paper P with high fidelity in accordance with the image data.

Figure 4:
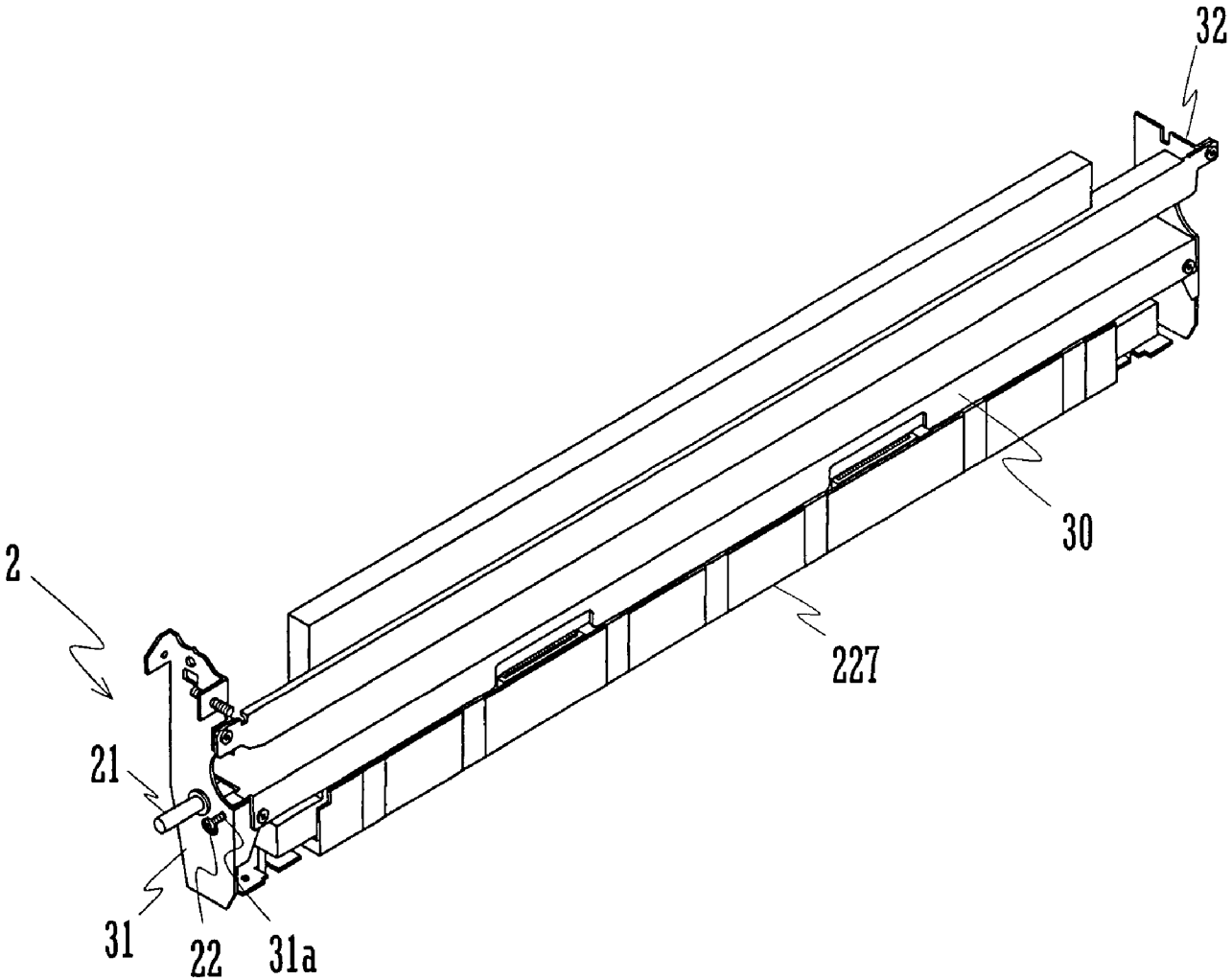
FIG. 4 is a perspective view of the LED head associated with an adjustment mechanism used in the focus adjustment method of the embodiment.

FIG. 4 is a perspective view of the LED head 227 assembled with an adjustment mechanism 2 used in the focus adjustment method applied to the optical writing unit of the present embodiment. The LED head 227 is installed at a specific position in the digital image forming apparatus 1 with the aid of the adjustment mechanism 2. The adjustment mechanism 2 is surrounded by a front bracket 31, a rear bracket 32 and a frame 30 for supporting the LED head 227. Both ends of the LED head 227 in its longitudinal direction (main scanning direction) are supported by a support shaft 21 which extends outward beyond both ends of the frame 30 via adjustment screws 22, the support shaft 21 being supported by the front bracket 31 and the rear bracket 32.

The distances from both ends of the LED head 227 to the photosensitive drum 222 are varied by turning the adjustment screws 22. After installing the LED head 227 at a specific position in the digital image forming apparatus 1, the adjustment screws 22 are turned to vary the distances from both ends of the LED head 227 to the photosensitive drum 222 to thereby adjust the focus of the LED head 227.

Figure 5:
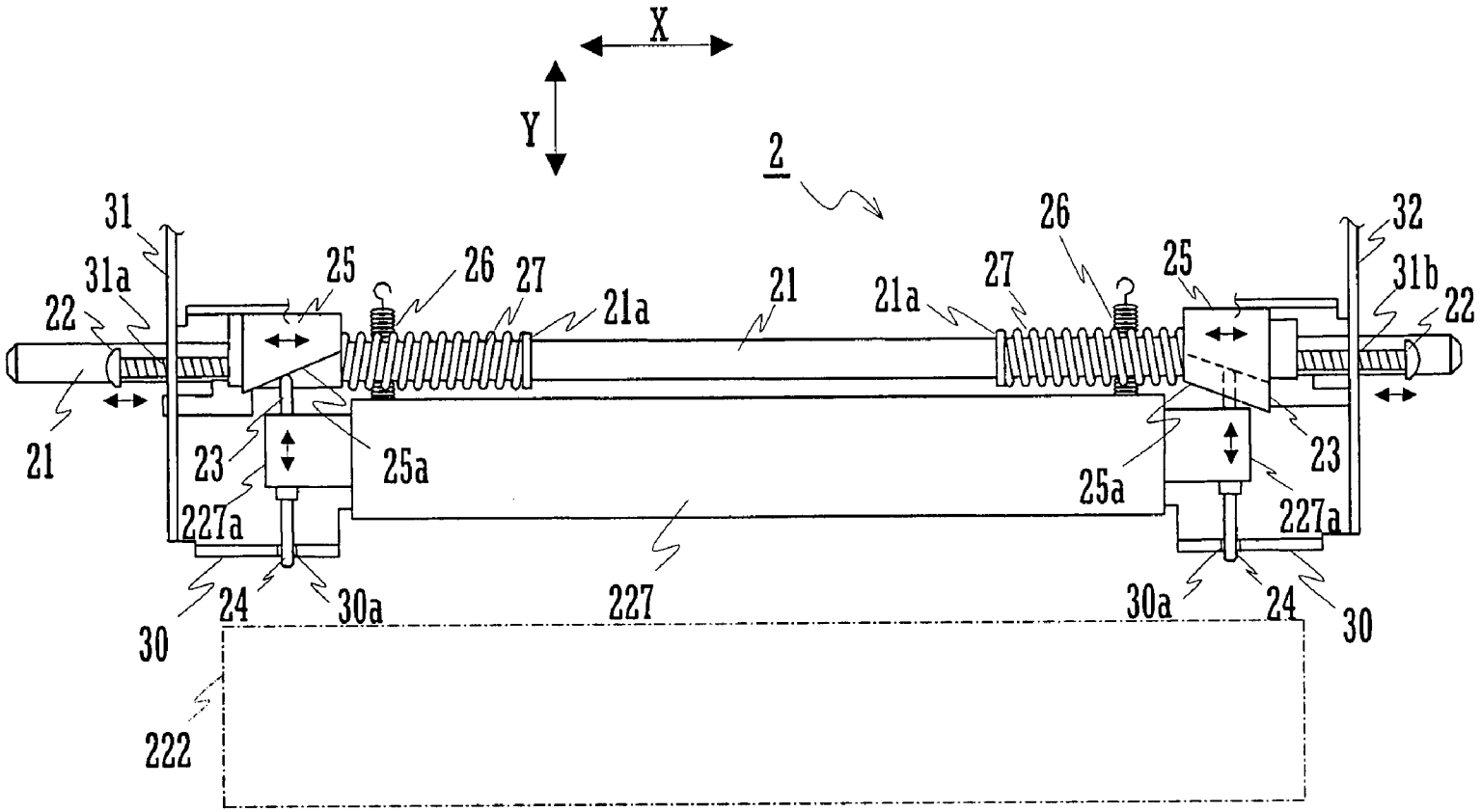
FIG. 5 is a diagram showing the construction of the adjustment mechanism.
Figure 6:
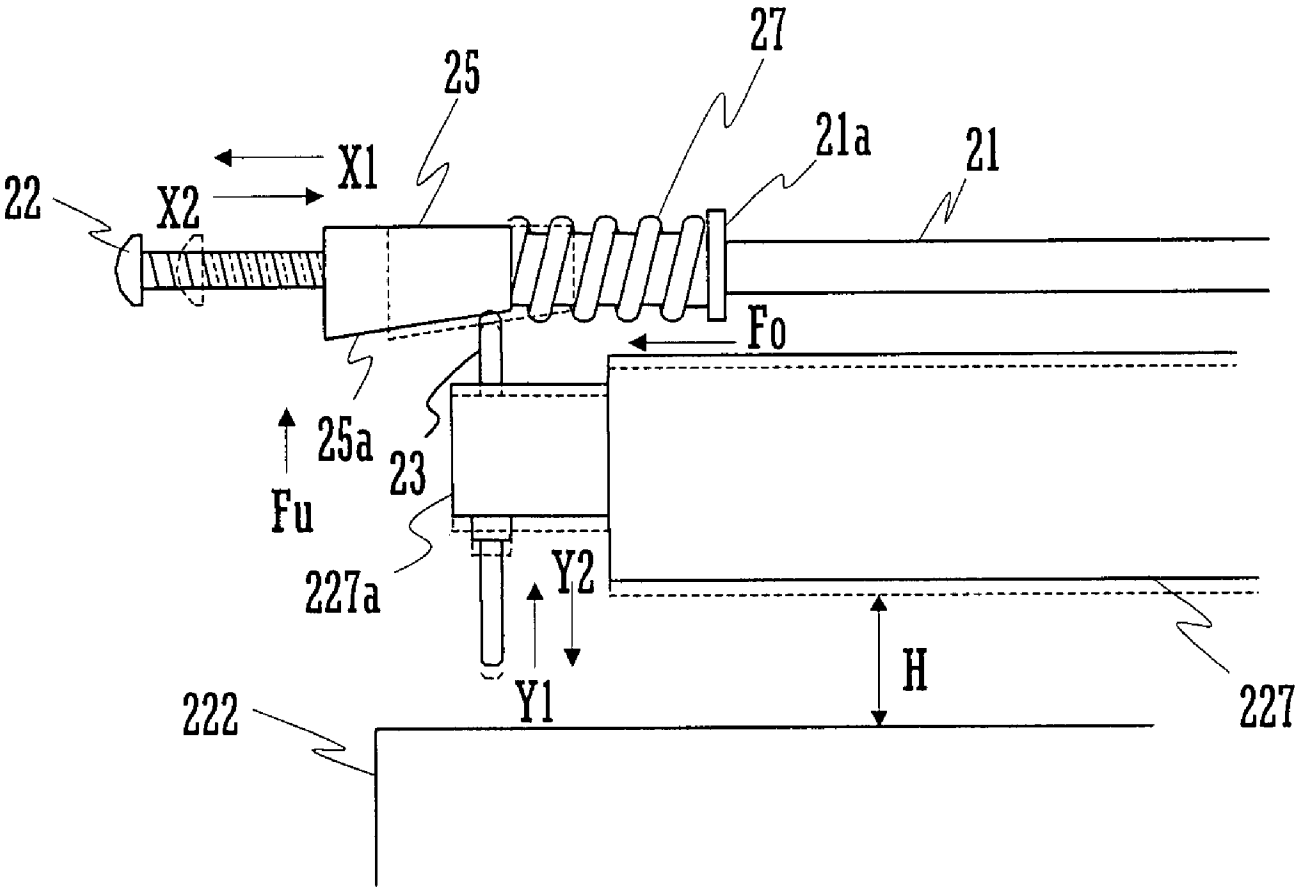
FIG. 6 is a diagram showing adjustment operation performed by the adjustment mechanism.

FIG. 5 is a diagram showing the construction of the adjustment mechanism 2, and FIG. 6 is a diagram showing adjustment operation performed by the adjustment mechanism 2. There are formed head support portions 227a at both ends of the LED head 227 extending therefrom. A contact pin 23 and a support pin 24 extending in vertical directions (designated by arrows Y1 and Y2 in FIG. 6) perpendicular to the longitudinal direction of the LED head 227 (designated by arrows X1 and X2 in FIG. 6) are provided at each head support portion 227*a*.

Upper ends of the contact pins 23 extending upward from the head support portions 227*a* of the LED head 227 are held in contact with slant surfaces 25*a* of movable sleeves 25 slidably fitted over both terminal portions of the support shaft 21. On the other hand, lower ends of the support pins 24 extending downward from the head support portions 227*a* of the LED head 227 are fitted in U-shaped slots 30*a* formed in the frame 30. The LED head 227 is affixed to ends of a pair of helical springs 26 of which opposite ends are hooked to the frame 30, so that the LED head 227 is always biased upward by elastic forces exerted by the springs 26.

The support shaft 21 interconnecting the front bracket 31 and the rear bracket 32 is located above the LED head 227. Helical springs 27 are fitted over both terminal portions of the support shaft 21. Inner ends of the springs 27 are held in contact with flanges 21*a* radially projecting from a cylindrical outer surface of the support shaft 21 and outer ends of the springs 27 are held in contact with inside surfaces of the movable sleeves 25 which are slidably fitted over both terminal portions of the support shaft 21. With this arrangement, the movable sleeves 25 are biased toward both ends of the support shaft 21 by elastic forces exerted by the springs 27.

There are formed screw holes 31*a* and 32*a* in which the adjustment screws 22 are fitted in the front bracket 31 and the rear bracket 32, respectively. Tip ends of the adjustment screws 22 fitted in the screw holes 31*a*, 32*a* from the outside of the front bracket 31 and the rear bracket 32 are held in contact with outside surfaces of the movable sleeves 25. With this arrangement, the movable sleeves 25 are caused to move in the longitudinal direction (main scanning direction) of the support shaft 21 shown by the arrow X1 or X2 by or against the elastic forces exerted by the springs 27 when the adjustment screws 22 are turned.

If the movable sleeve 25 is displaced in the direction of the arrow X1 or X2, the upper end of the contact pin 23 which is in contact with the slant surface 25*a* of the movable sleeve 25 moves in the direction of the arrow Y1 or Y2 as well as in the direction of the arrow X1 or X2. As the contact point of the contact pin 23 at its upper end shifts along the slant surface 25*a* of the movable sleeve 25 in the direction of the arrow Y1 or Y2 in this fashion, the LED head 227 biased upward by the springs 26 is vertically displaced by or against the elastic forces exerted by the springs 26.

More particularly, if the adjustment screw 22 is turned so that the movable sleeve 25 is displaced in the direction of the arrow X1 by the elastic force exerted in the direction of an arrow Fo by the helical spring 27, the contact point of the contact pin 23 at its upper end shifts upward along the slant surface 25*a* of the movable sleeve 25 and, at the same time, the elastic force exerted in the direction of an arrow Fu by the spring 26 (not shown in FIG. 6) causes the LED head 227 to shift in the direction of the arrow Y1 as shown in FIG. 6. Similarly, if the adjustment screw 22 is turned in an opposite direction against the elastic force exerted in the direction of an arrow Fo by the spring 27 so that the movable sleeve 25 is displaced in the direction of the arrow X2, the contact point of the contact pin 23 at its upper end shifts downward along the slant surface 25*a* of the movable sleeve 25 and, at the same time, the LED head 227 is displaced in the direction of the arrow Y2 against the elastic force exerted in the direction of an arrow Fu by the spring 26 (not shown in FIG. 6).

The distance H between the LED head 227 and the surface of the photosensitive drum 222 is adjusted by turning the adjustment screws 22 to displace both ends of the LED head 227 in the direction of the arrow Y1 or Y2 in the aforementioned manner. As can be seen from FIG. 5, the adjustment mechanism 2 has a symmetrical arrangement at both ends of the LED head 227, so that the distance H between the LED head 227 and the surface of the photosensitive drum 222 can be adjusted independently at the individual ends (front and rear) of the LED head 227. The amount of displacement of each movable sleeve 25 in the directions of the arrows X1 and X2 is proportional to the amount of rotation of the adjustment screw 22, and the slant surface 25*a* of each movable sleeve 25 with which the upper end of the contact pin 23 is in contact is a flat surface. Thus, the amount of displacement of the LED head 227 in the vertical direction is proportional to the amount of rotation of the individual adjustment screws 22. In other words, the distance H between the LED head 227 and the surface of the photosensitive drum 222 varies at a fixed rate in relation to the amount of rotation of the individual adjustment screws 22.

Figure 7:
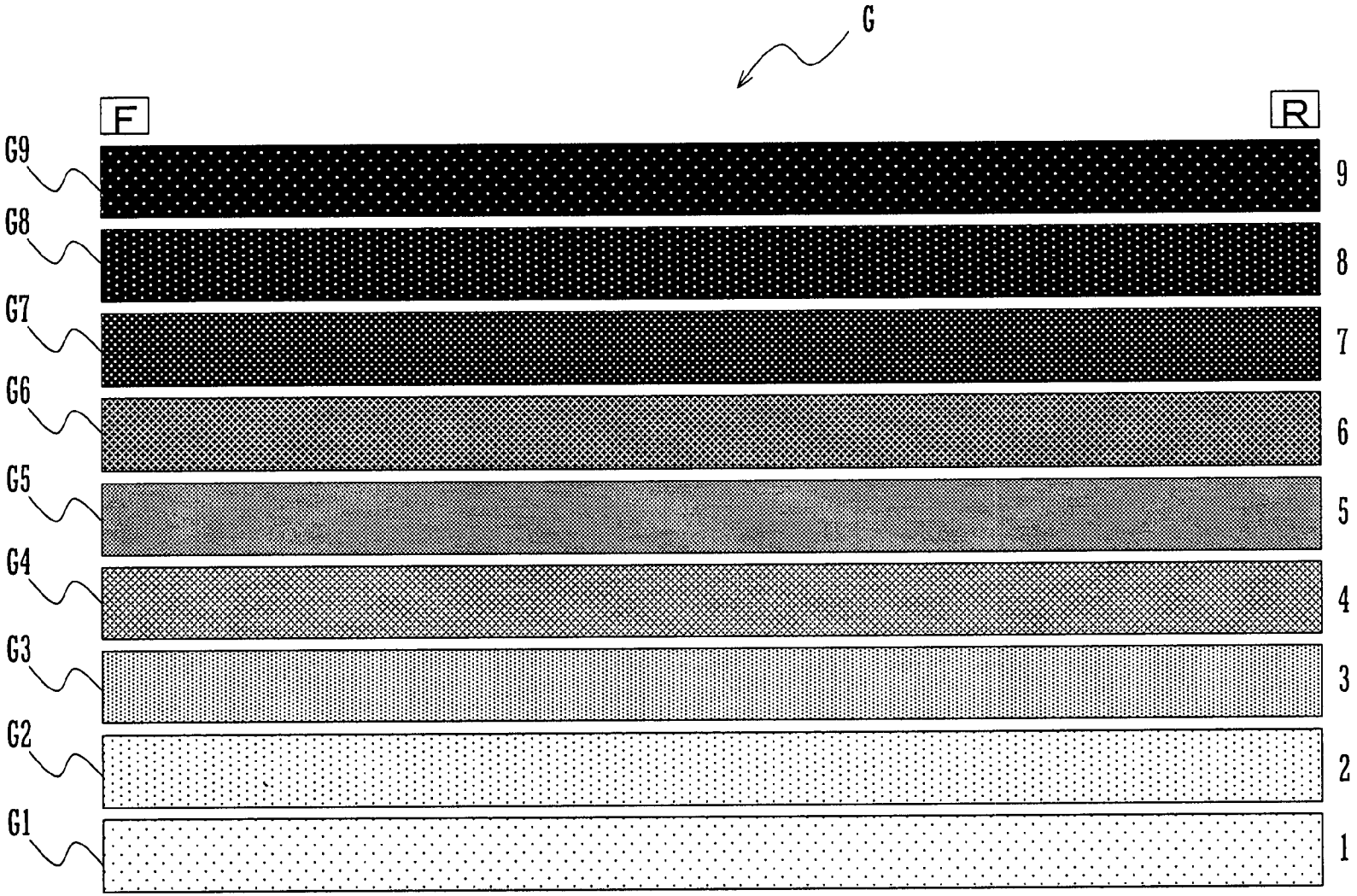
FIG. 7 is a diagram showing a test pattern used for focus adjustment of the LED head according to the focus adjustment method of the embodiment.

FIG. 7 is a diagram showing a test pattern G used for focus adjustment of the LED head 227 according to the focus adjustment method of the embodiment. A focus adjustment procedure is performed for properly adjusting the distance H between the LED head 227 and the surface of the photosensitive drum 222 to achieve an accurate reproduction of an original image on the paper P with high fidelity in accordance with the image data. In this focus adjustment procedure, the test pattern G is reproduced by the digital image forming apparatus 1 and the adjustment screws 22 are adjusted based on the appearance of reproduced test pattern images.

The test pattern G of FIG. 7 includes 9 gray-scale bars G1–G9 of varying density values, for example, and the letters "F" and "R" indicating the front and rear sides of the LED head 227. The bars G1–G9, which correspond to multiple pattern elements in the present invention, are numbered "1" to "9" indicating the amounts of adjustment (adjustment quantity information). These numbers correspond to respective steps (densities) of gray scale. The beltlike bars G1–G9 each have a length generally equal to the extent of the entire scan area in the main scanning direction. The individual bars G1–G9 have 9-step density levels which will be obtained from an original image of a particular density by performing image forming operation while gradually moving the LED head 227 away from a position of correct focus where the light emitted from the LED head 227 is focused on the surface of the photosensitive drum 222 by turning the adjustment screws 22 in a specific direction by a specific amount in 8 successive steps (e.g., by one rotation at a time in a direction of separating the LED head 227 from the photosensitive drum 222).

The numbers marked to the right of the individual bars G1–G9 indicate the amounts of adjustment corresponding to the respective density levels expressed in terms of the number of rotations of each adjustment screw 22. For example, the number "1" marked to the right of the bar G1 of the lowest density level means that if the image of the lightest bar G1 is not formed (printed) on the paper P in the focus adjustment procedure, the LED head 227 can be moved up to the position of correct focus closer to the photosensitive drum 222 by turning each adjustment screw 22 by one rotation. The numbers marked to the right of the individual gray-scale bars G1–G9 need not necessarily be incremented by one but may be incremented by 2, 0.5 or 0.25, for example. What is essential in this embodiment is that these numbers should indicate the numbers of rotations of each adjustment screw 22 that the operator can achieve within the relationship between the range of density levels of the bars G1–G9 and the pitch, or the number of threads, of the adjustment screws 22.

The test pattern G can be prepared based on results of image forming operation performed on many digital image forming apparatuses 1, in which a reference original image is reproduced with the LED head 227 set at 9 different positions while moving it away from the surface of the photosensitive drum 222 in incremental steps starting from the position of correct focus. The test pattern G thus prepared serves to prevent maladjustment of focus which may occur due to variations in the characteristics of different LED heads 227.

Figure 8A:
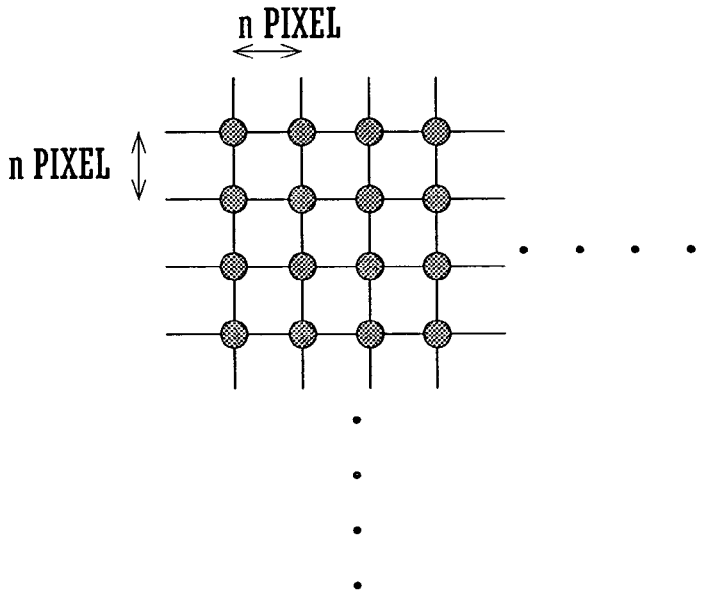
FIGS. 8A–8C are diagrams showing how the focus adjustment test pattern is formed when the photosensitive drum has coatings of multi-valued image sensitive substances.
Figure 8B:
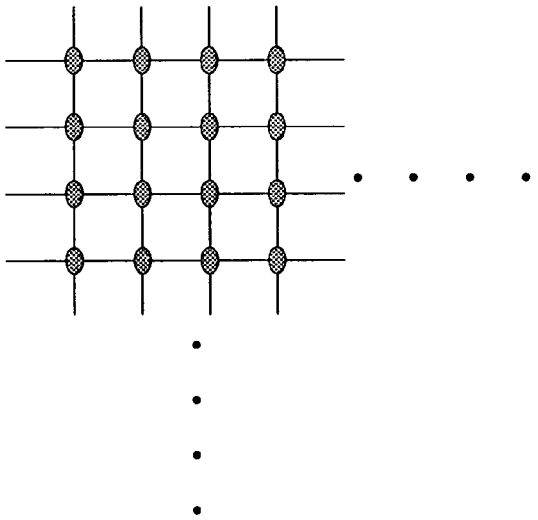
Figure 8C:
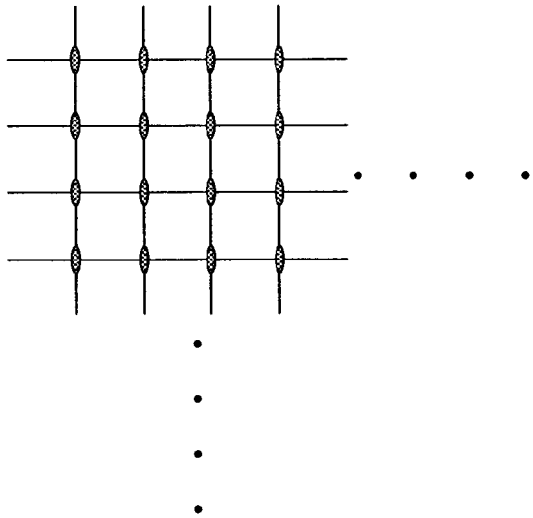

FIGS. 8A–8C are diagrams showing how the test pattern G used for focus adjustment is formed when the photosensitive drum 222 has coatings of multi-valued image sensitive substances. In this case, shades of individual bars G1–G9 are formed by dots marked at intervals of n pixels (n=5 in the illustrated examples) in both the main scanning and sub-scanning directions. The number n may be determined in accordance with image forming characteristics of the digital image forming apparatus 1. The dots need not necessarily be arranged in a checkerboard pattern as shown in FIGS. 8A–8C but may be arranged in a staggered form. The 9-step density levels of the individual bars G1–G9 can be produced by varying light-emitting time or light-emitting power input to the LEDs 11 (light-emitting elements) corresponding to the pixels forming the dots of the LED head 227. To produce dots of higher density levels, the light-emitting time or the light-emitting power input to the relevant LEDs 11 is increased so that the diameter of each dot increases as shown in FIG. 8A. To produce dots of lower density levels, on the contrary, the light-emitting time or the light-emitting power input to the relevant LEDs 11 is decreased so that the diameter of each dot decreases as shown in FIG. 8C.

Figure 9A:
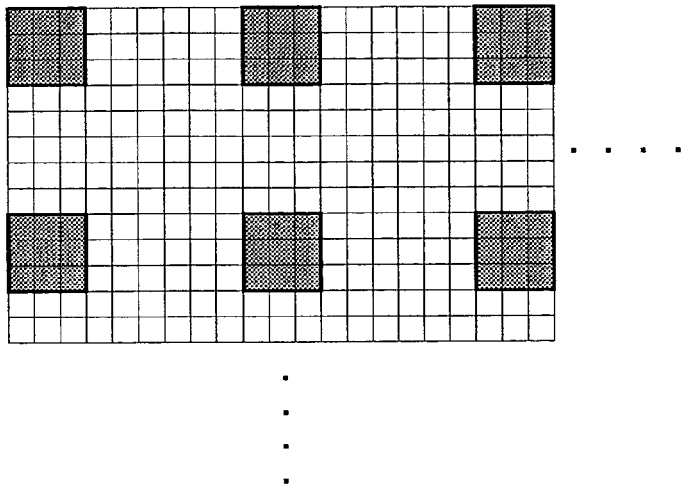
FIGS. 9A–9C are diagrams showing how the focus adjustment test pattern is formed when the photosensitive drum has a coating of a binary image sensitive substance.
Figure 9B:
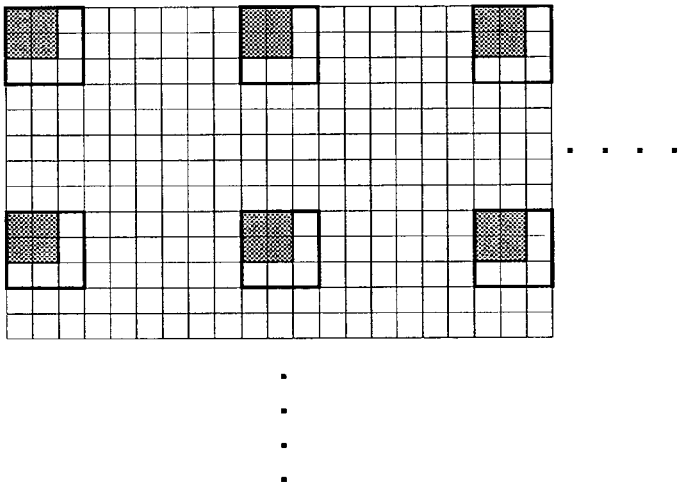
Figure 9C:
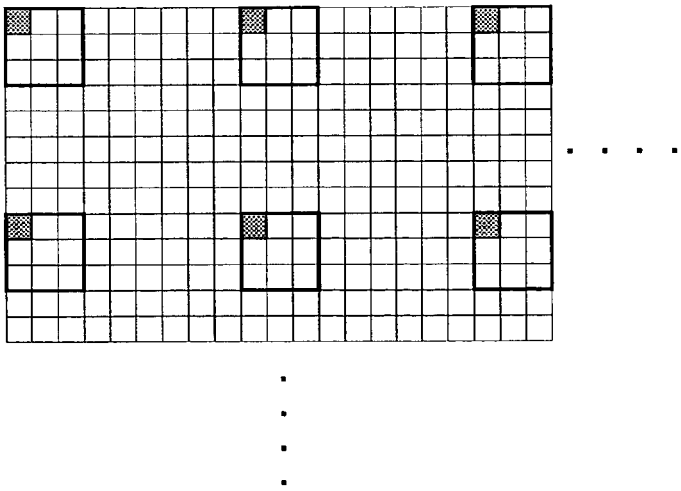

FIGS. 9A–9C are diagrams showing how the test pattern G used for focus adjustment is formed when the photosensitive drum 222 has a coating of a binary image sensitive substance. In this case, it is impossible to vary the diameter of individual dots, so that 9-step density levels of the individual bars G1–G9 are produced by varying the number of illuminated LEDs 11 (pixels) of the LED head 227. To produce dots of higher density levels, the number of illuminated LEDs 11 in each dot area is increased to increase black pixel areas as shown in FIG. 9A. To produce dots of lower density levels, on the contrary, the number of illuminated LEDs 11 in each dot area is decreased to decrease black pixel areas as shown in FIG. 9C.

Figure 11:
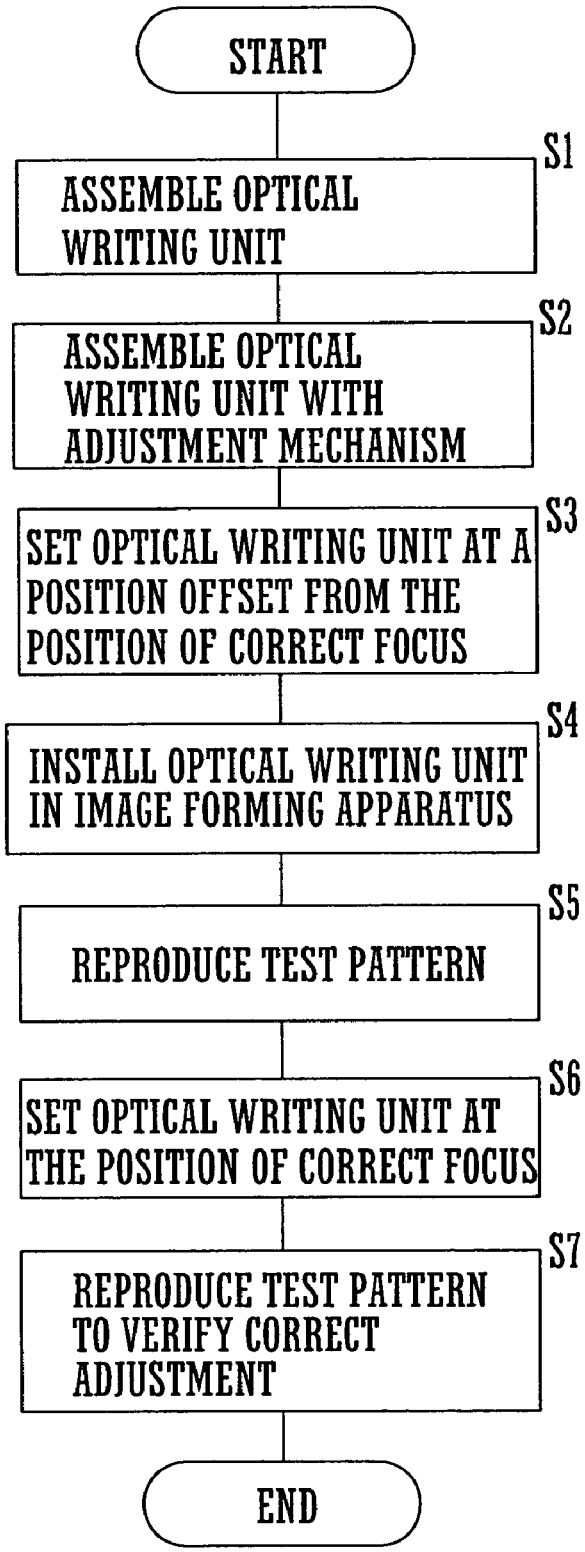
FIG. 11 is a flowchart showing a flow of operations performed in the focus adjustment procedure.
Figure 12A:
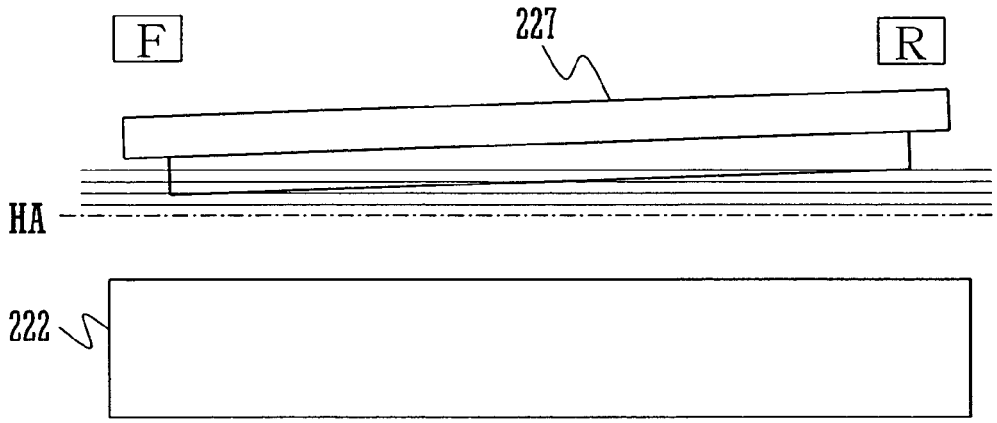
FIGS. 12A–12C are diagrams showing the LED head differently positioned with respect to the photosensitive drum before performing the focus adjustment procedure.
Figure 12B:
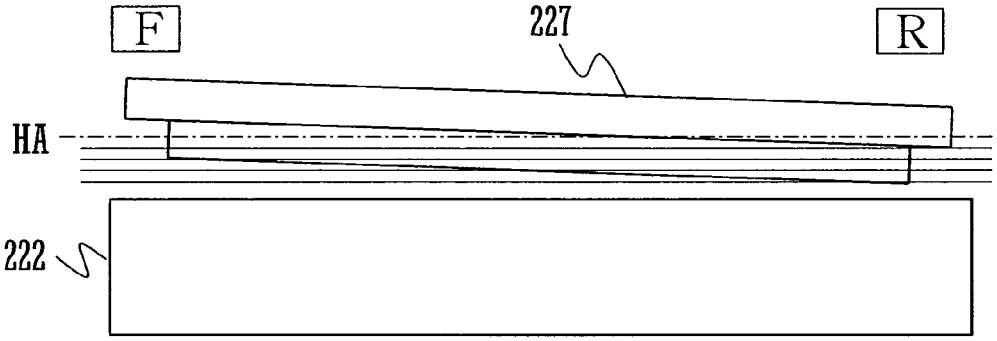
Figure 12C:
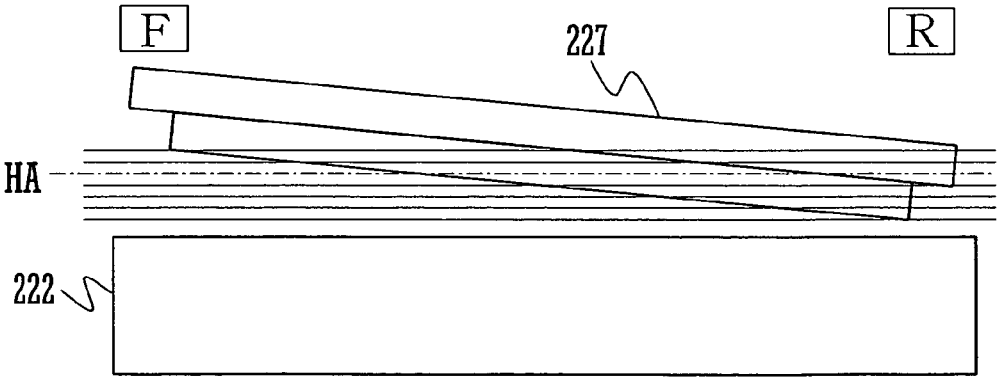

FIG. 11 is a flowchart showing a flow of operations performed in the aforementioned focus adjustment procedure. First, the LED head 227 which is the optical writing unit of the invention is assembled (step S1), and the LED head 227 is assembled with the adjustment mechanism 2 (step S2). Then, the LED head 227 is set at a position offset from the position of correct focus, namely from a position HA as shown in FIGS. 12A to 12C, in a particular direction by a specific amount by turning the adjustment screws 22 of the adjustment mechanism 2 (step S3). The LED head 227 thus assembled and set in the adjustment mechanism 2 is installed in the digital image forming apparatus 1 (step S4), and the test pattern G is reproduced on a sheet of paper P (step S5). The LED head 227 is set to the position HA, by turning the adjustment screws 22 referring to an image G' of the test pattern G reproduced on the paper P by the image forming operation of step S5 (step S6). Finally, the test pattern G is reproduced again to verify that the LED head 227 has been set at the position of correct focus (step S7). It is to be noted that step S7 may be eliminated. It is possible to finish the focus adjustment procedure by once performing the image forming operation (reproduction of the test pattern G) according to the flow of FIG. 11. In this focus adjustment procedure, step S5 corresponds to a pattern image forming process and step S6 corresponds to a position adjustment process mentioned in the appended claims.

In the focus adjustment procedure of FIG. 11, the test pattern G shown in FIG. 7 is reproduced (image forming operation) and the distance H between the LED head 227 and the surface of the photosensitive drum 222 is properly adjusted by turning the adjustment screws 22 of the adjustment mechanism 2 referring to the appearance of the reproduced image G' on the paper P in the above-described manner. Let us assume that the reproduced image G' of the test pattern G looks like the one shown in FIG. 10, for example. It can be seen from this reproduced image G' that bars G1' and G2' are blank (not reproduced) on the front side and bars G1' to G4' are blank (not reproduced) on the rear side. This example shows that the distance H between the LED head 227 and the surface of the photosensitive drum 222 can be properly adjusted on both the front and rear sides along the main scanning direction by two turns of the front adjustment screw 22 as indicated by the number "2" at the right of the bar G2' and by four turns of the rear adjustment screw 22 as indicated by the number "4" at the right of the bar G4'.

The aforementioned arrangement of the embodiment makes it possible to easily recognize the amount of offset of the LED head 227 from its position of correct focus with respect to the surface of the photosensitive drum 222 in terms of the number of rotations of the adjustment screws 22 on the front and rear sides along the main scanning direction.

It is however impossible to recognize whether the front and rear ends of the LED head 227 are too close to or too far from the surface of the photosensitive drum 222 with respect to the position of correct focus. If the image G' shown in FIG. 10 has been formed on the paper P by reproducing the test pattern G of FIG. 7, for example, the LED head 227 may be currently positioned as shown in FIG. 12A or 12B with respect to the photosensitive drum 222.

If the LED head 227 is currently positioned as shown in FIG. 12A, it is necessary to turn the front adjustment screw 22 by as much as two clockwise rotations and the rear adjustment screw 22 by as much as four clockwise rotations to lower the LED head 227 to bring it to the position HA all along the main scanning direction. If the LED head 227 is currently positioned as shown in FIG. 12B, on the other hand, it is necessary to turn the front adjustment screw 22 by as much as two counterclockwise rotations and the rear adjustment screw 22 by as much as four counterclockwise rotations to raise the LED head 227 to bring it to the position HA all along the main scanning direction.

As it is impossible to determine whether each adjustment screw 22 should be turned clockwise or counterclockwise from the result of just a single image forming operation (reproduction of the test pattern G) in the aforementioned arrangement, it is necessary for the operator to turn each adjustment screw 22 in one arbitrary direction and re-execute the image forming operation before the operator can determine the correct turning direction of the individual adjustment screws 22.

To overcome this awkwardness in focus adjustment operation, the LED head 227 is initially positioned apparently closer to or farther away from the photosensitive drum 222 than the position HA when installing the LED head 227 in the digital image forming apparatus 1, and the aforementioned image forming operation (reproduction of the test pattern G) is performed under this condition. This arrangement enables the operator to recognize without doubt whether the LED head 227 is currently positioned as depicted in FIG. 12A or 12B with respect to the photosensitive drum 222 and easily determine the turning direction of the adjustment screws 22.

If the LED head 227 is installed aslant with its front end raised, however, the LED head 227 may be positioned as shown in FIG. 12C rather than FIG. 12B. In this case, it is necessary to turn the front adjustment screw 22 by as much as two clockwise rotations to lower the front end of the LED head 227 and to turn the rear adjustment screw 22 by as much as four counterclockwise rotations to raise the rear end of the LED head 227.

To save the amount of toner consumed for executing the aforementioned focus adjustment procedure, central portions of the individual bars G1–G9 may be eliminated leaving only their end portions. If the central portions of the bars G1–G9 are eliminated, however, it is impossible to determine whether the LED head 227 is currently positioned as depicted in FIG. 12A or 12B from the reproduced image G' of the test pattern G. It is therefore preferable to use a test pattern including uninterrupted image segments having as larger an extent as possible along the main scanning direction in the image forming operation. To meet this requirement, the test pattern may be configured by multiple short bars G1–Gn arranged along the main scanning direction.

While the invention has been described, by way of example, with reference to the digital image forming apparatus 1 having the single LED head 227 for producing black and white copies, the invention can be implemented in a multi-color digital image forming apparatus having multiple LED heads 227, producing a particularly significant advantage. The digital image forming apparatus 1 may employ an optical writing unit of other solid-state light source scanning type like the one formed of EL-type light-emitting elements, for example, instead of the LED head 227.

The aforementioned focus adjustment method using the optical writing unit of the invention provides various advantageous effects as explained below.

According to the focus adjustment method of the embodiment, the test pattern G carrying the multiple bars G1–G9 of different density levels corresponding to varying amounts of adjustment is reproduced on a printing medium (sheet of paper P) whereby the operator can adjust the position of the optical writing unit (the LED head 227) with respect to the surface of the image-carrying member (the photosensitive drum 222) referring to the amounts of adjustment indicated by the density levels of the respective bars G1–G9 on the printing medium. The operator can easily recognize the amounts of adjustment for bringing the optical writing unit to a proper position with respect to the surface of the image-carrying member by checking out the density levels of the unprinted bars on the printing medium, so that the operator can perform operation for focus adjustment of the optical writing unit with respect to the surface of the image-carrying member with ease and precision regardless of whether the optical writing unit is for forming binary or multi-valued images.

According to the invention, focus adjustment of the optical writing unit is made referring to the appearance of the image G' of the test pattern G reproduced on the printing medium, the test pattern G including the uninterrupted bars G1–G9 extending generally all along the main scanning direction. With the aid of this test pattern G, the operator can recognize the amount of offset of the optical writing unit from its position of correct focus generally all along the main scanning direction and determine whether the optical writing unit is offset to one side of the position of correct focus all along the length of the optical writing unit (FIG. 12A or 12B) or a middle portion of the length of the optical writing unit is situated at the position of correct focus (FIG. 12C). This enables the operator to determine the direction of adjustment of the optical writing unit with high accuracy, thereby facilitating the focus adjustment operation.

In one aspect of the invention, the multiple bars G1–G9 having different density levels are formed by varying the diameter of each dot (FIGS. 8A–8C). This approach makes it possible to correctly produce the bars G1–G9 of the test pattern G used for determining the amounts of adjustment of the optical writing unit during the focus adjustment procedure in a case where the image forming apparatus employs an image-carrying member having coatings of multi-valued image sensitive substances, whereby density level differences of the bars G1–G9 can be clearly expressed on the printing medium. Consequently, the operator can properly perform focus adjustment of the optical writing unit referring to the appearance of the image G' of the test pattern G reproduced on the printing medium.

In another aspect of the invention, the multiple bars G1–G9 having different density levels are formed by varying the number of pixels illuminated in specific segmental areas (FIGS. 9A–9C). This approach makes it possible to correctly produce the bars G1–G9 of the test pattern G used for determining the amounts of adjustment of the optical writing unit during the focus adjustment procedure in a case where the image forming apparatus employs an image-carrying member having a coating of a binary image sensitive substance, whereby density level differences of the bars G1–G9 can be clearly expressed on the printing medium. Consequently, the operator can properly perform focus adjustment of the optical writing unit referring to the appearance of the image G' of the test pattern G reproduced on the printing medium.

In another aspect of the invention, the multiple bars G1–G9 having different density levels are produced by varying light-emitting time of the individual light-emitting elements (LEDs 11) of the optical writing unit. This makes it possible to easily form the bars G1–G9 having different density levels of the test pattern G used for determining the amounts of adjustment of the optical writing unit during the focus adjustment procedure in a case where the image forming apparatus employs an image-carrying member having coatings of multi-valued image sensitive substances.

In another aspect of the invention, the multiple bars G1–G9 having different density levels are produced by varying light-emitting power input to the individual light-emitting elements of the optical writing unit. This also makes it possible to easily form the bars G1–G9 having different density levels of the test pattern G used for determining the amounts of adjustment of the optical writing unit during the focus adjustment procedure in a case where the image forming apparatus employs an image-carrying member having coatings of multi-valued image sensitive substances.

In still another aspect of the invention, the multiple bars G1–G9 on the test pattern G used for determining the amounts of adjustment of the optical writing unit during the focus adjustment procedure are associated with the earlier-mentioned adjustment quantity information indicating the amounts of adjustment corresponding to the density levels of the individual bars G1–G9. This makes it possible to easily recognize the amounts of adjustment of the position of the optical writing unit referring to the appearance of the image G' of the test pattern G reproduced on the printing medium. Consequently, the operator can easily recognize the amounts of adjustment of the optical writing unit based on the appearance of the image G' of the test pattern G reproduced on the printing medium.

In yet another aspect of the invention, the optical writing unit is initially installed at an offset position closer to or farther away from the surface of the image-carrying member than a position where light emitted from the individual light-emitting elements is supposed to focus on the surface of the image-carrying member, and the image G' of the test pattern G is reproduced with the optical writing unit thus installed. According to this arrangement, the direction of adjustment in which the optical writing unit should be moved for its focus adjustment is predetermined. This approach enables the operator to exactly recognize from a single reproduction of the test pattern G in which direction the optical writing unit should be moved to achieve correct focus adjustment.

In a further aspect of the invention, if the direction in which the optical writing unit is offset when assembling it with the adjustment mechanism 2 before installation in the image forming apparatus is predetermined, it is easy to initially offset both ends of the optical writing unit in the same direction from the position of correct focus.

Figure 13:
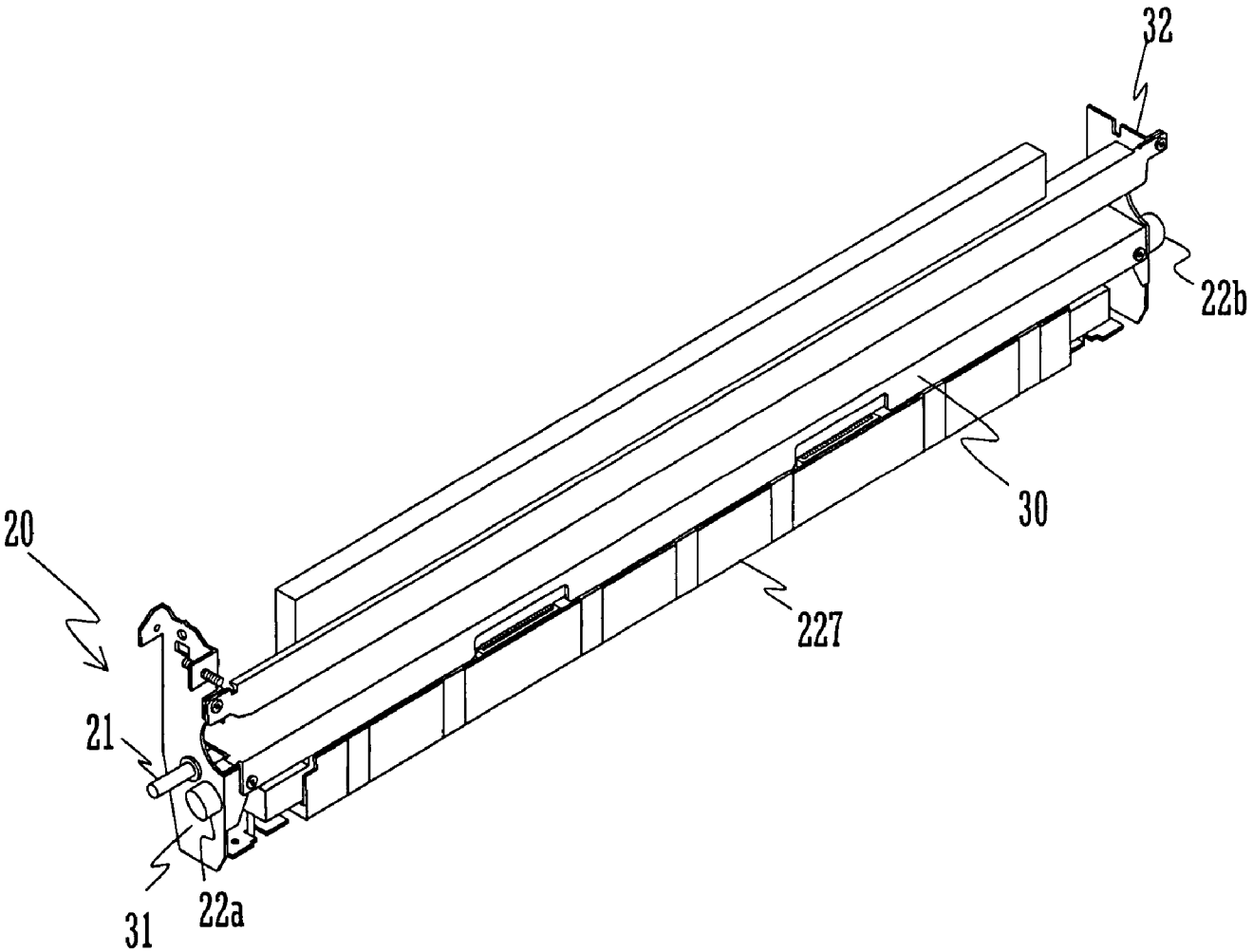
FIG. 13 is a perspective view of the LED head associated with an adjustment mechanism which constitutes a focus adjustment device according to a variation of the embodiment.
Figure 14:
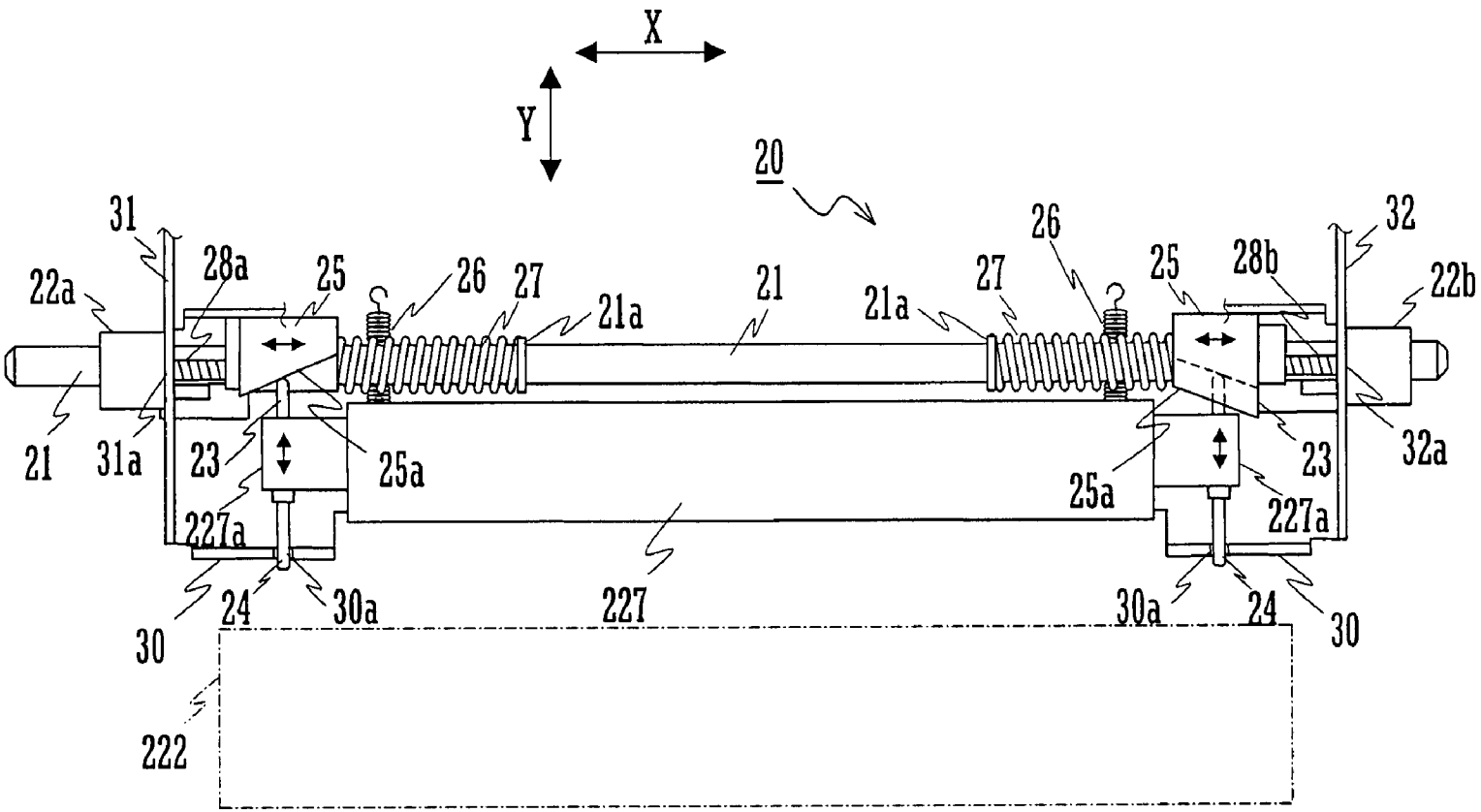
FIG. 14 is a diagram showing the construction of the adjustment mechanism of FIG. 13.
Figure 15:
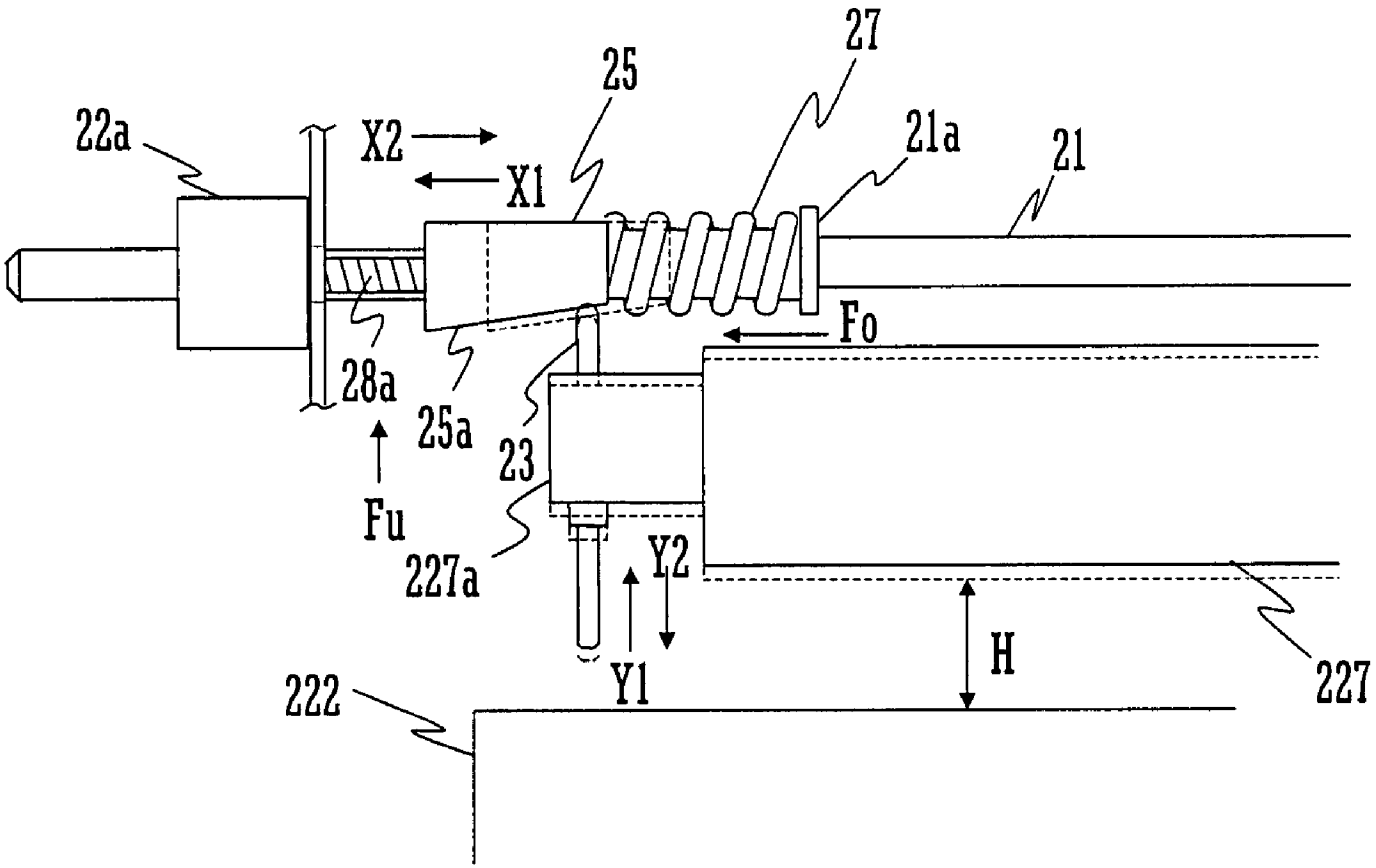
FIG. 15 is a diagram showing adjustment operation performed by the adjustment mechanism of FIG. 13.

FIG. 13 is a perspective view of the LED head 227 associated with an adjustment mechanism 20 which constitutes a focus adjustment device according to a variation of the foregoing embodiment, FIG. 14 is a diagram showing the construction of the adjustment mechanism 20 of FIG. 13, and FIG. 15 is a diagram showing adjustment operation performed by the adjustment mechanism 20 of FIG. 13.

The LED head 227 is installed at a specific position in the digital image forming apparatus 1 with the aid of the adjustment mechanism 2 which constitutes the focus adjustment device of this variation of the foregoing embodiment. The adjustment mechanism 20 has essentially the same construction as the adjustment mechanism 2 shown in FIGS. 4–6 except that a front side adjustment motor 22*a* and a rear side adjustment motor 22*b* are mounted on the front bracket 31 and the rear bracket 32, respectively.

In this adjustment mechanism 20, the distances from both ends of the LED head 227 to the photosensitive drum 222 vary as in the adjustment mechanism 2 when the front and rear side adjustment motors 22*a*, 22*b* are run. After installing the LED head 227 at a specific position in the digital image forming apparatus 1, the front and rear side adjustment motors 22*a*, 22*b* are caused to turn to vary the distances from both ends of the LED head 227 to the photosensitive drum 222 to thereby adjust the focus of the LED head 227.

There are formed screw holes 31*a* and 32*a* in which adjustment screws 28*a* and 28*b* are fitted in the front bracket 31 and the rear bracket 32, respectively. Tip ends of the adjustment screws 28*a*, 28*b* fitted in the screw holes 31*a*, 32*a* from the outside of the front bracket 31 and the rear bracket 32 are held in contact with outside surfaces of the movable sleeves 25. Outer ends of the adjustment screws 28*a*, 28*b* extending beyond outside surfaces of the front and rear brackets 31, 32 are joined to rotational shafts of front and rear side adjustment motors 22*a*, 22*b* which are fixed to the outside surfaces of the brackets 31, 32. Thus, the adjustment screws 28*a*, 28*b* turn when the front and rear side adjustment motors 22*a*, 22*b* are run. As a result, the movable sleeves 25 move in the longitudinal direction (main scanning direction) of the support shaft 21 shown by arrow X1 or X2 in FIG. 15 by or against the elastic forces exerted by the springs 27.

If the movable sleeve 25 is displaced in the direction of the arrow X1 or X2, the upper end of the contact pin 23 which is in contact with the slant surface 25*a* of the movable sleeve 25 moves in the direction of the arrow Y1 or Y2 as well as in the direction of the arrow X1 or X2. As the contact point of the contact pin 23 at its upper end shifts along the slant surface 25*a* of the movable sleeve 25 in the direction of the arrow Y1 or Y2 in this fashion, the LED head 227 biased upward by the springs 26 is vertically displaced by or against the elastic forces exerted by the springs 26.

More particularly, if the adjustment screw 28*a* is turned by turning the front side adjustment motor 22*a* in its forward running direction so that the movable sleeve 25 is displaced in the direction of the arrow X1 by the elastic force exerted in the direction of an arrow Fo by the helical spring 27, the contact point of the contact pin 23 at its upper end shifts upward along the slant surface 25*a* of the movable sleeve 25 and, at the same time, the elastic force exerted in the direction of an arrow Fu by the spring 26 (not shown in FIG. 15) causes the LED head 227 to shift in the direction of the arrow Y1 as shown in FIG. 15. Similarly, if the adjustment screw 28*b* is turned in an opposite direction against the elastic force exerted in the direction of an arrow Fo by the spring 27 by turning the front side adjustment motor 22*a* in its reverse running direction so that the movable sleeve 25 is displaced in the direction of the arrow X2, the contact point of the contact pin 23 at its upper end shifts downward along the slant surface 25*a* of the movable sleeve 25 and, at the same time, the LED head 227 is displaced in the direction of the arrow Y2 against the elastic force exerted in the direction of an arrow Fu by the spring 26 (not shown in FIG. 15). The rear end of the LED head 227 can be shifted up and down in a similar fashion by turning the rear side adjustment motor 22*b*.

The distance H between the LED head 227 and the surface of the photosensitive drum 222 is adjusted by actuating the front and rear side adjustment motors 22*a*, 22*b* to turn the adjustment screws 28*a*, 28*b* to displace both ends of the LED head 227 in the direction of the arrow Y1 or Y2 in the aforementioned manner. As can be seen from FIG. 14, the adjustment mechanism 20 has a symmetrical arrangement at both ends of the LED head 227, so that the distance H between the LED head 227 and the surface of the photosensitive drum 222 can be adjusted independently at the individual ends (front and rear) of the LED head 227. The amount of displacement of each movable sleeve 25 in the directions of the arrows X1 and X2 is proportional to the amount of rotation of the adjustment screws 28*a* and 28*b*, or the number of rotation of the front side adjustment motor 22*a* or the rear side adjustment motor 22*b*, and the slant surface 25*a* of each movable sleeve 25 with which the upper end of the contact pin 23 is in contact is a flat surface. Thus, the amount of displacement of the LED head 227 in the vertical direction is proportional to the amount of rotation of the front side adjustment motor 22*a* or the rear side adjustment motor 22*b*. In other words, the distance H between the LED head 227 and the surface of the photosensitive drum 222 varies at a fixed rate in relation to the amount of rotation of the front side adjustment motor 22*a* or the rear side adjustment motor 22*b*.

In the construction of the invention, the contact pins 23, the movable sleeves 25, and the adjustment screws 28*a*, 28*b* together constitute a moving mechanism, the frame 30 corresponds to a retainer and the adjustment motors 22*a*, 22*b* correspond to an actuator mentioned in the appended claims. Also, the contact pins 23, the movable sleeves 25, the adjustment screws 28*a*, 28*b*, the frame 30 and the adjustment motors 22*a*, 22*b* together constitute an adjustment mechanism mentioned in the appended claims.

Figure 16:
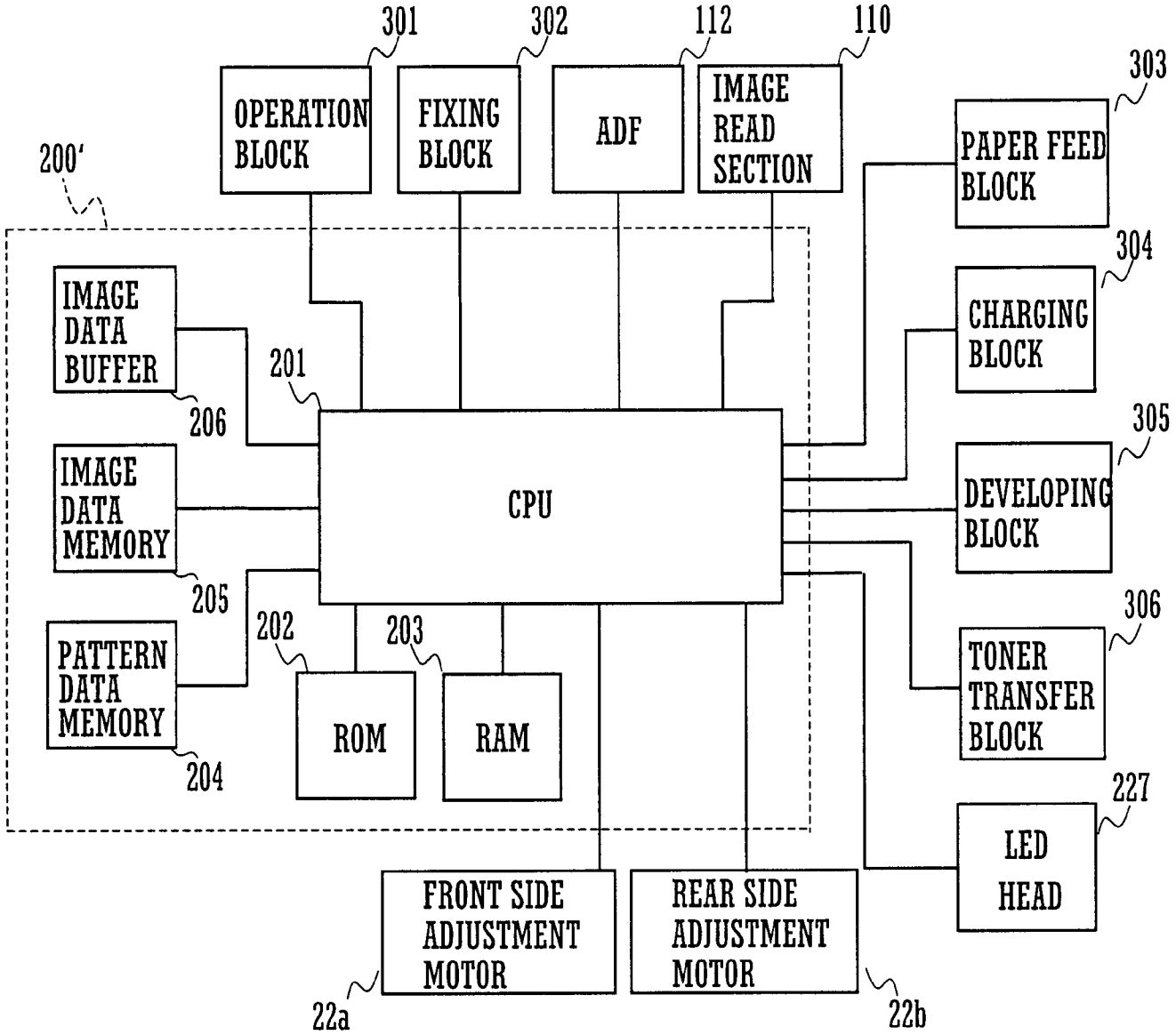
FIG. 16 is a block diagram showing the configuration of a controller of a digital image forming apparatus incorporating the focus adjustment device according to the variation of FIG. 13.

FIG. 16 is a block diagram showing the configuration of a controller 200' of a digital image forming apparatus incorporating the focus adjustment device (the adjustment mechanism 20) of FIG. 13. The controller 200' of the digital image forming apparatus incorporating the focus adjustment device has essentially the same construction as the controller 200 shown in FIG. 2 except that the CPU 201 is connected to the front side adjustment motor 22*a* and the rear side adjustment motor 22*b*.

The test pattern G shown in FIG. 7 is used for focus adjustment of the LED head 227 performed by use of the focus adjustment device (the adjustment mechanism 20) of FIG. 13. The test pattern G is produced by the method illustrated in FIGS. 8A–8C or FIGS. 9A–9C.

Figure 17:
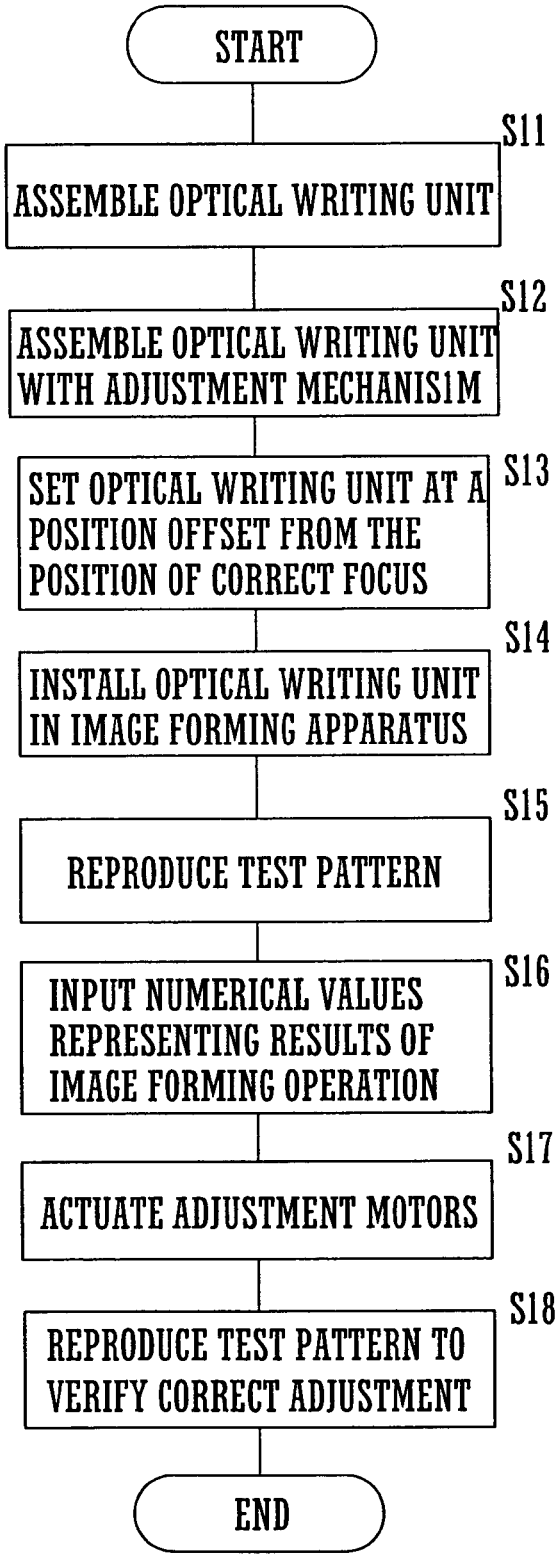
FIG. 17 is a flowchart showing a first flow of operations performed in a focus adjustment procedure by the focus adjustment device of FIG. 13.

FIG. 17 is a flowchart showing a first flow of operations performed in a focus adjustment procedure by the focus adjustment device of FIG. 13. First, the LED head 227 which is the optical writing unit of the invention is assembled (step S11), and the LED head 227 is assembled with the adjustment mechanism 2 (step S12). Here, the CPU 201 of the controller 200' actuates the adjustment motors 22*a*, 22*b* to set the LED head 227 at a position offset from the position of correct focus in a particular direction by a specific amount (step S13). The LED head 227 thus assembled and set in the adjustment mechanism 2 is installed in the digital image forming apparatus 1 (step S14), and the test pattern G is reproduced on a sheet of paper P (step S15).

Figure 18:
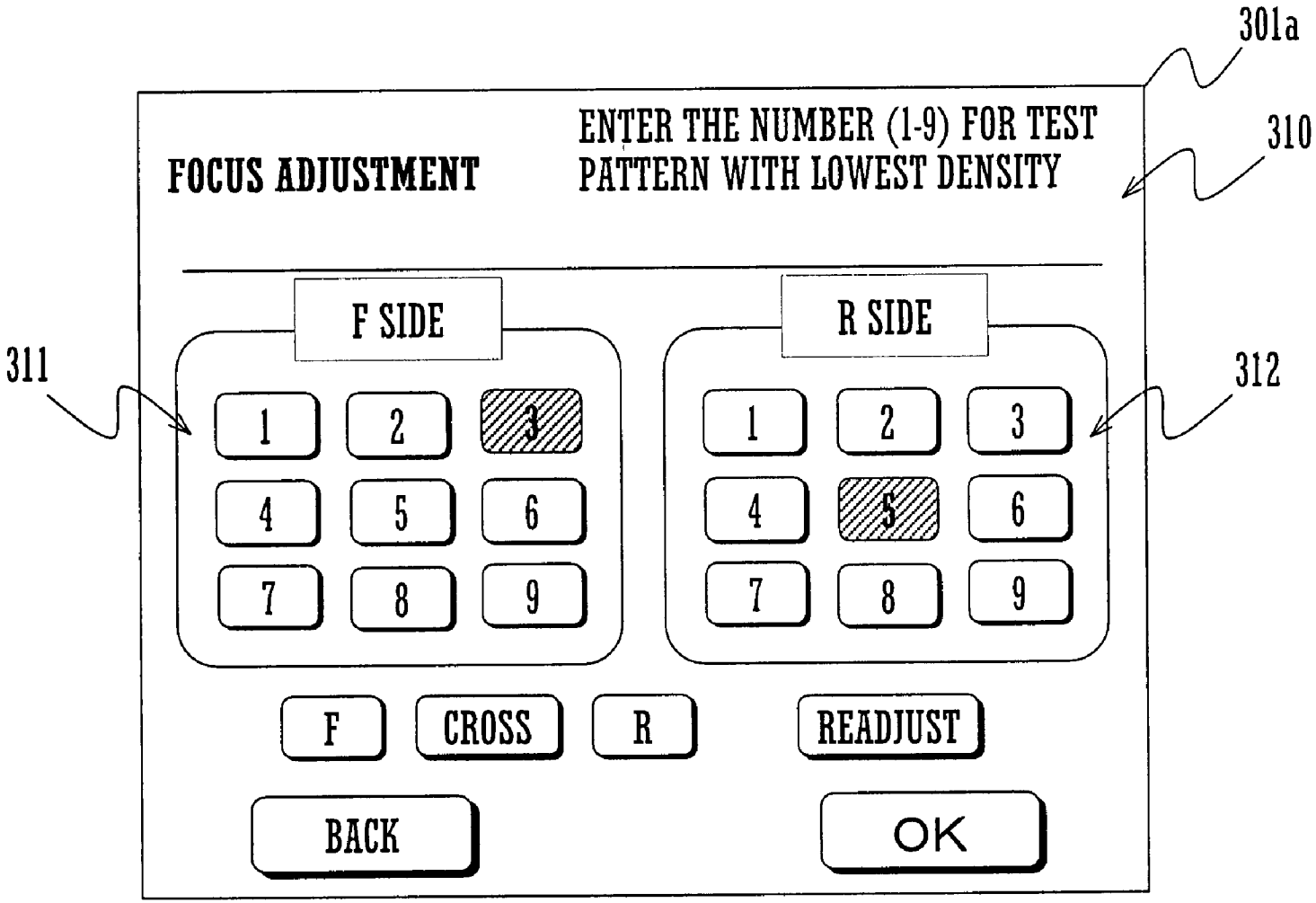
FIG. 18 is a diagram showing a focus adjustment screen presented on a display of an operation block during the focus adjustment operation.

During focus adjustment operation, a display 301*a* provided on the operation block 301 of the digital image forming apparatus 1 presents a focus adjustment screen 310 shown in FIG. 18. The focus adjustment screen 310 includes a front side density setup keypad 311 and a rear side density setup keypad 312. The front and rear side density setup keypads 311, 312 on the display 301*a* together constitute an input section mentioned in the appended claims. These density setup keypads 311, 312 accept numerical inputs. Specifically, the density setup keypads 311, 312 are used to enter the numbers affixed to gray scale bars of the lowest density levels visible on the paper P at the front and rear sides of an image G' of the test pattern G reproduced by the image forming operation of step S15 above.

The operator inputs numerical values representing the results of the image forming operation referring to the appearance of the reproduced image G' on the paper P through the front and rear side density setup keypads 311, 312 according to instructions shown on the focus adjustment screen 310 on the display 301a (step S16). Then, the CPU 201 of the controller 200' actuates the adjustment motors 22*a*, 22*b* according to a program previously written in the ROM 202 (step S17). The ROM 202 stores information on the relationship between the numerical values to be input through the front and rear side density setup keypads 311, 312 and the numbers of rotations of the adjustment motors 22*a*, 22*b*. The front and rear adjustment motors 22*a*, 22*b* individually turn as much as the numbers of rotations corresponding to the numerical values input through the front and rear side density setup keypads 311, 312.

As a result of step S17, the adjustment screws 28*a*, 28*b* turn by as much as the necessary amounts of rotation and the LED head 227 is set to the position of correct focus, or at the correct distance H from the surface of the photosensitive drum 222. Finally, the test pattern G is reproduced again to verify that the LED head 227 has been set at the position of correct focus (step S18). It is to be noted that step S18 may be eliminated. The operator examines the appearance of the reproduced image G' on the paper P obtained by performing the image forming operation (reproduction of the test pattern G) and inputs the numerical values representing the results of the image forming operation into the operation block 301. Upon execution of this operation, the LED head 227 is automatically set to the position of correct focus with respect to the surface of the photosensitive drum 222.

According to the focus adjustment procedure of FIG. 17, the operator reproduces the test pattern G shown in FIG. 7 and causes the adjustment motors 22*a*, 22*b* of the adjustment mechanism 2 to turn by the amounts determined referring to the appearance of the reproduced image G' on the paper P. As a result, the distance H between the LED head 227 and the surface of the photosensitive drum 222 can be properly adjusted with ease.

Figure 10:
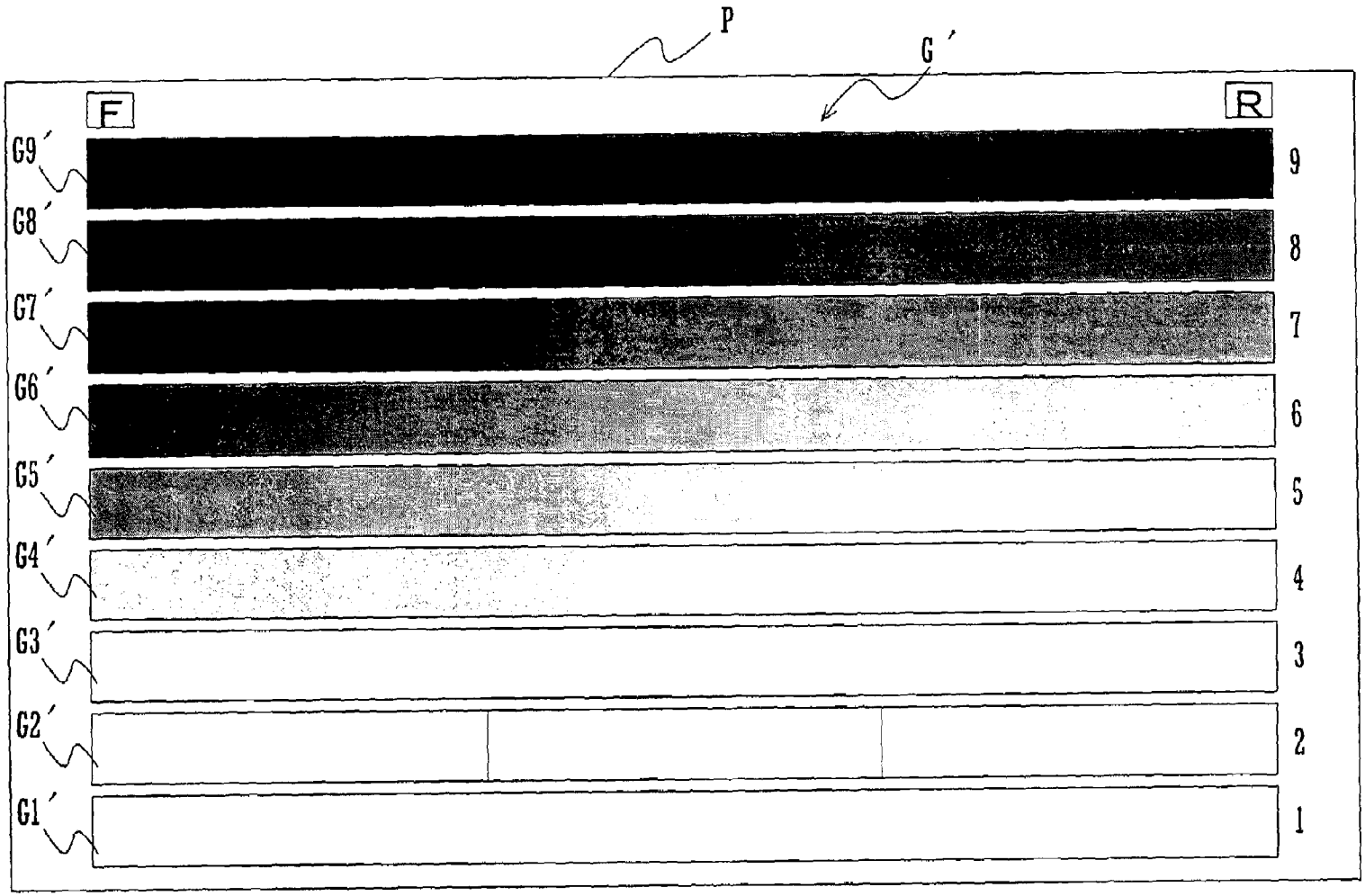
FIG. 10 is a diagram showing an image of the test pattern reproduced in a focus adjustment procedure.

Let us assume that the reproduced image G' of the test pattern G looks like the one shown in FIG. 10, for example. It can be seen from this reproduced image G' that the bars G1' and G2' are blank (not reproduced) on the front side and the bars G1' to G4' are blank (not reproduced) on the rear side. Accordingly, the operator inputs the number "3" affixed to the bar G3' through the front side density setup keypad 311 and the number "5" affixed to the bar G5' through the rear side density setup keypad 312. As a result, the CPU 201 causes the front side adjustment motor 22*a* to turn by as much as two rotations and the rear side adjustment motor 22*b* to turn by as much as four rotations, for example, whereby the distance H between the LED head 227 and the surface of the photosensitive drum 222 can be properly adjusted on both the front and rear sides along the main scanning direction.

Figure 19:
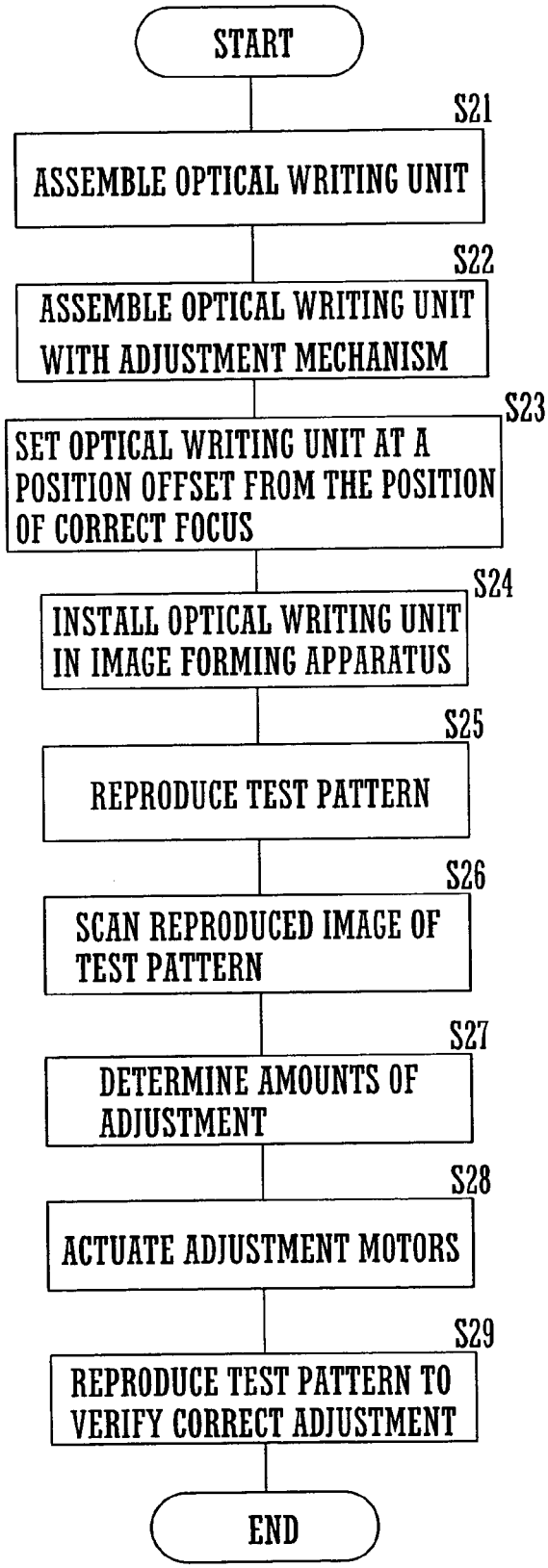
FIG. 19 is a flowchart showing a second flow of operations performed in a focus adjustment procedure by the focus adjustment device of FIG. 13.

FIG. 19 is a flowchart showing a second flow of operations performed in a focus adjustment procedure by the focus adjustment device of FIG. 13. First, the LED head 227 which is the optical writing unit of the invention is assembled (step S21), and the LED head 227 is assembled with the adjustment mechanism 2 (step S22). Here, the CPU 201 of the controller 200' actuates the adjustment motors 22*a*, 22*b* to set the LED head 227 at a position offset from the position of correct focus in a particular direction by a specific amount (step S23). The LED head 227 thus assembled and set in the adjustment mechanism 2 is installed in the digital image forming apparatus 1 (step S24), and the test pattern G is reproduced on a sheet of paper P (step S25).

The operator places the paper P carrying an image G' of the test pattern G reproduced in step S25 above on the platen glass 111 and presses a start key provided in the operation block 301. Consequently, the CPU 201 of the controller 200' performs an image reading operation to read the reproduced image G' on the paper P (step S26). The CPU 201 determines from image data thus read the numbers (numerical values) affixed to gray scale bars of the lowest density levels visible on the paper P at the front and rear sides of the reproduced image G' (step S27). Then, the CPU 201 causes the adjustment motors 22*a*, 22*b* to turn as much as the numbers of rotations corresponding to the numerical values determined in step S27 (step S28).

As a result of step S28, the adjustment screws 28*a*, 28*b* turn by as much as the necessary amounts of rotation and the LED head 227 is set to the position of correct focus, or at the correct distance H from the surface of the photosensitive drum 222. Finally, the test pattern G is reproduced again to verify that the LED head 227 has been set at the position of correct focus (step S29). It is to be noted that step S29 may be eliminated. In executing the focus adjustment procedure, the operator needs to just place the paper P carrying the reproduced image G' of the test pattern G on the platen glass 111. As a result, the LED head 227 is automatically set to the position of correct focus with respect to the surface of the photosensitive drum 222.

According to the aforementioned focus adjustment procedure, the amounts of offset of the front and rear ends of the LED head 227 from its position of correct focus with respect to the surface of the photosensitive drum 222 are visually determined and manually input (operation flow of FIG. 17), or automatically determined by the image reading operation (operation flow of FIG. 19), and the adjustment motors 22*a*, 22*b* are turned as much as the numbers of rotations corresponding to the amounts of offset thus determined, whereby the LED head 227 is set to the position of correct focus with respect to the surface of the photosensitive drum 222.

As discussed earlier with reference to FIGS. 12A–12C, there are cases where it is impossible to determine the direction in which each of the adjustment screws 28*a*, 28*b* should be turned to achieve satisfactory focus adjustment from the result of just a single image forming operation (reproduction of the test pattern G). Therefore, the LED head 227 should be initially positioned apparently closer to or farther away from the photosensitive drum 222 than the position of correct focus when installing the LED head 227 in the digital image forming apparatus 1, and the image forming operation (reproduction of the test pattern G) should be performed under this condition as mentioned with reference to the focus adjustment procedure illustrated in FIG. 11.

Also, the test pattern may be configured by multiple short bars G1–Gn arranged along the main scanning direction, and the invention can be implemented in a multi-color digital image forming apparatus having multiple LED heads 227, as mentioned earlier with reference to the focus adjustment procedure illustrated in FIG. 11.

The aforementioned optical writing unit of the invention provides various advantageous effects as explained below.

According to the invention, the test pattern G carrying the multiple bars G1–G9 of different density levels corresponding to varying amounts of adjustment is reproduced on a printing medium (sheet of paper P) and the position of the optical writing unit (the LED head 227) is varied referring to the amounts of adjustment indicated by the density levels of the respective bars G1–G9 reproduced on the printing medium such that the focal point of the light emitted from the individual light-emitting elements (LEDs 11) of the optical writing unit matches the surface of the image-carrying member (the photosensitive drum 222). This makes it possible to automatically displace the optical writing unit to bring it to the position of correct focus with respect to the surface of the image-carrying member based on the amounts of adjustment indicated by the density levels of the unprinted bars on the printing medium, thereby facilitating the focus adjustment operation.

According to the invention, the optical writing unit is held by the retainer (the frame 30) in such a way that the position of the optical writing unit with respect to the surface of the image-carrying member can be freely varied in the direction of the light emitted from the light-emitting elements by means of the moving mechanism (a combination of the contact pins 23, the movable sleeves 25, and the adjustment screws 28*a*, 28*b*), and the actuator (the adjustment motors 22*a*, 22*b*) controlled by the controller 200' provides the moving mechanism with motive power corresponding to the amounts of adjustment for moving the optical writing unit. With the motive power provided by the actuator to the moving mechanism in accordance with the amounts of adjustment fed from the controller 200', the retainer can hold the optical writing unit such that the focal point of the light emitted from the individual light-emitting elements matches the surface of the image-carrying member in a reliable fashion.

The amounts of adjustment visually determined referring to the appearance of the reproduced image G' of the test pattern G or automatically detected by reading (scanning) the reproduced image G' are entered to the adjustment mechanism 2 via an input section. Consequently, the position of the optical writing unit with respect to the surface of the image-carrying member can be precisely varied in the direction of the light emitted from the light-emitting elements as much as the amounts of adjustment visually determined referring to the appearance of the reproduced image G' of the test pattern G or automatically detected by reading (scanning) the reproduced image G' such that the focal point of the light emitted from the individual light-emitting elements matches the surface of the image-carrying member.

In one aspect of the invention, the position of the optical writing unit with respect to the surface of the image-carrying member is varied in the direction of the light emitted from the light-emitting elements such that the focal point of the light emitted from the individual light-emitting elements matches the surface of the image-carrying member based on the amounts of adjustment determined from the image data obtained by reading (scanning) the image G' of the test pattern G reproduced on the printing medium. According to this aspect of the invention, the operator simply places the printing medium carrying the reproduced image G' of the test pattern G on the platen glass 111 and causes the image forming apparatus to read the image G'. Consequently, the optical writing unit is automatically moved relative to the surface of the image-carrying member in the direction of the light emitted from the light-emitting elements such that the focal point of the light emitted from the individual light-emitting elements coincides with the surface of the image-carrying member.

In another aspect of the invention, focus adjustment of the optical writing unit is made based on the image G' of the test pattern G reproduced on the printing medium, the test pattern G including the uninterrupted bars G1–G9 extending generally all along the main scanning direction. With the aid of this test pattern G, the image forming apparatus can recognize or detect the amount of offset of the optical writing unit from its position of correct focus generally all along the main scanning direction and determine whether the optical writing unit is offset to one side of the position of correct focus all along the length of the optical writing unit (FIG. 12A or 12B) or a middle portion of the length of the optical writing unit is situated at the position of correct focus (FIG. 12C). Consequently, the image forming apparatus can determine the direction of adjustment of the optical writing unit with high accuracy.

In another aspect of the invention, the test pattern G including the multiple bars G1–G9 having different density levels is formed by varying the diameter of each dot (FIGS. 8A–8C). This approach makes it possible to correctly produce the bars G1–G9 of the test pattern G used for determining the amounts of adjustment of the optical writing unit during the focus adjustment procedure in a case where the image forming apparatus employs an image-carrying member having coatings of multi-valued image sensitive substances, whereby density level differences of the bars G1–G9 can be clearly expressed on the printing medium.

In another aspect of the invention, the test pattern G including the multiple bars G1–G9 having different density levels is formed by varying the number of pixels illuminated in specific segmental areas (FIGS. 9A–9C). This approach makes it possible to correctly produce the bars G1–G9 of the test pattern G used for determining the amounts of adjustment of the optical writing unit during the focus adjustment procedure in a case where the image forming apparatus employs an image-carrying member having a coating of a binary image sensitive substance, whereby density level differences of the bars G1–G9 can be clearly expressed on the printing medium.

In another aspect of the invention, the test pattern G including the multiple bars G1–G9 having different density levels is produced by varying light-emitting time of the individual light-emitting elements (LEDs 11) of the optical writing unit. This makes it possible to easily form the bars G1–G9 of the test pattern G used for determining the amounts of adjustment of the optical writing unit by controlling the light-emitting time of the individual light-emitting elements during the focus adjustment procedure in a case where the image forming apparatus employs an image-carrying member having coatings of multi-valued image sensitive substances.

In another aspect of the invention, the test pattern G including the multiple bars G1–G9 having different density levels is produced by varying light-emitting power input to the individual light-emitting elements of the optical writing unit. This also makes it possible to easily form the bars G1–G9 of the test pattern G used for determining the amounts of adjustment of the optical writing unit by controlling the light-emitting power input to the individual light-emitting elements during the focus adjustment procedure in a case where the image forming apparatus employs an image-carrying member having coatings of multi-valued image sensitive substances.

In still another aspect of the invention, the multiple bars G1–G9 on the test pattern G used for determining the amounts of adjustment of the optical writing unit during the focus adjustment procedure are associated with the earlier-mentioned adjustment quantity information indicating the amounts of adjustment corresponding to the density levels of the individual bars G1–G9. This makes it possible to easily recognize or detect the amounts of adjustment of the position of the optical writing unit referring to the adjustment quantity information shown on the image G' of the test pattern G reproduced on the printing medium.

In yet another aspect of the invention, the optical writing unit is initially installed at an offset position closer to or farther away from the surface of the image-carrying member than a position where light emitted from the individual light-emitting elements is supposed to focus on the surface of the image-carrying member, and the image G' of the test pattern G is reproduced with the optical writing unit thus installed. According to this arrangement, the direction of adjustment in which the optical writing unit should be moved for its focus adjustment is predetermined. This makes it possible to exactly recognize or detect from a single reproduction of the test pattern G in which direction the optical writing unit should be moved to achieve correct focus adjustment.

In a further aspect of the invention, the test pattern G carrying the multiple bars G1–G9 of different density levels corresponding to varying amounts of adjustment is reproduced on a printing medium and the position of the optical writing unit is varied referring to the amounts of adjustment indicated by the density levels of the respective bars G1–G9 reproduced on the printing medium such that the focal point of the light emitted from the individual light-emitting elements of the optical writing unit matches the surface of the image-carrying member, before performing image forming operation. It is therefore possible to reproduce original images with high accuracy with the light emitted from the individual light-emitting elements of the optical writing unit exactly focused on the surface of the image-carrying member.

In a still further aspect of the invention, the test pattern G carrying the multiple bars G1–G9 of different density levels corresponding to varying amounts of adjustment is reproduced on a printing medium, the image G' of the test pattern G thus reproduced on the printing medium is read (scanned) by the image forming apparatus, and the amounts of adjustment of the position of the optical writing unit are determined from the image data obtained by reading (scanning) the image G'. According to this aspect of the invention, the operator simply places the printing medium carrying the reproduced image G' of the test pattern G on the platen glass 111 and causes the image forming apparatus to read the image G'. Consequently, the optical writing unit is automatically displaced such that the focal point of the light emitted from the individual light-emitting elements coincides with the surface of the image-carrying member, thereby facilitating the focus adjustment operation.

What is claimed is:

1. A focus adjustment method for an optical writing unit extending from a first end to a second end transversely across a surface of an image-carrying member, said focus adjustment method comprising:

a pattern image forming process utilizing said optical writing unit to form a test pattern by projecting light modulated by image data of the test pattern from an array of multiple light-emitting elements corresponding to pixels arranged along the main scanning direction over an image forming area onto said surface of said image-carrying member, converting an electrostatic latent image formed on said surface of said image-carrying member into a visible toner image, and transferring said visible toner image from said surface of said image-carrying member onto a printing medium, said test pattern including;

uninterrupted multiple pattern elements disposed generally all along said image forming area in a main scanning direction, said multiple pattern elements being of gradually varying density levels corresponding to different amounts of adjustment; and adjustment quantity information showing the amount of adjustment corresponding to the density levels of said multiple pattern elements; and a position adjustment process for separately adjusting the position of said ends of said optical writing unit in such a manner that said optical writing unit is positioned at a proper distance from, and parallel to, said surface of said image-carrying member based on density levels of end portions of each of said multiple pattern elements of said test pattern formed on said printing medium and based upon said adjustment quantity information.

2. The focus adjustment method for the optical writing unit according to claim 1, wherein said pattern image forming process is a process in which the diameter of individual dots constituting the pattern elements of the test pattern is varied according to the density levels of the pattern elements.

3. The focus adjustment method for the optical writing unit according to claim 2, wherein said pattern image forming process is a process in which light-emitting time of the individual light-emitting elements is controlled according to the density levels of the individual pattern elements of the test pattern.

4. The focus adjustment method for the optical writing unit according to claim 2, wherein said pattern image forming process is a process in which light-emitting power input to the individual light-emitting elements is controlled according to the density levels of the individual pattern elements of the test pattern.

5. The focus adjustment method for the optical writing unit according to claim 1, wherein said pattern image forming process is a process in which the pattern elements of the test pattern are binary pattern elements formed of the pixels according to their varying density levels.

6. The focus adjustment method for the optical writing unit according to claim 1 further comprising an assembly process for installing the optical writing unit at an offset position closer to or farther away from the image-carrying member than a position where the focal point of the light emitted from the individual light-emitting elements is expected to coincide with the surface of the image-carrying member before execution of said pattern image forming process.

7. The focus adjustment method for the optical writing unit according to claim 6, wherein said assembly process is performed when both ends of the optical writing unit at extremities of the image forming area in the main scanning direction are affixed to an adjustment mechanism.

8. A focus adjustment device for an optical writing unit having first and second ends, said focus adjustment device comprising:

a memory for storing data on a test pattern, the test pattern including:

multiple uninterrupted pattern elements of gradually varying density levels corresponding to different amounts of adjustment extending all along a main scanning direction in an image forming area; and adjustment quantity information denoting the amount of adjustment corresponding to the density levels of the pattern elements;

an image former including said optical writing unit for performing image forming operation to form the test pattern stored in the memory; and an adjustment mechanism for separately adjusting the position of each end of said optical writing unit relative to a surface of an image-carrying member in a direction of light emitted from multiple light-emitting elements corresponding to pixels arranged along a main scanning direction over said image forming area in such a manner that said optical writing unit is positioned at a proper distance from, and parallel to, said surface of said image-carrying member according to said adjustment quantity information.

9. The focus adjustment device for the optical writing unit according to claim 8, wherein said adjustment mechanism includes:

a retainer for holding the optical writing unit via a moving mechanism in such a way that the position of the optical writing unit relative to the surface of the image-carrying member can be freely varied in the direction of the light emitted from the light-emitting elements;

an actuator for providing the moving mechanism with motive power for varying the position of the optical writing unit; and a controller for controlling operation of the actuator according to said amounts of adjustment.

10. The focus adjustment device for the optical writing unit according to claim 8, wherein said adjustment mechanism includes an input section for accepting an input of the amount of adjustment determined with reference to an image of the test pattern formed on a printing medium by the image forming operation based on the data stored in the memory.

11. The focus adjustment device for the optical writing unit according to claim 8, wherein said adjustment mechanism varies the position of the optical writing unit relative to the surface of the image-carrying member in the direction of the light emitted from the light-emitting elements according to the amount of adjustment determined from image data obtained by reading an image of the test pattern formed on a printing medium by the image forming operation based on the data stored in the memory.

12. The focus adjustment device for the optical writing unit according to claim 8, wherein said image former varies the diameter of individual dots constituting the pattern elements of the test pattern according to the density levels of the pattern elements.

13. The focus adjustment device for the optical writing unit according to claim 12, wherein said image former controls light-emitting time of the individual light-emitting elements according to the density levels of the individual pattern elements of the test pattern.

14. The focus adjustment device for the optical writing unit according to claim 12, wherein said image former controls light-emitting power input to the individual light-emitting elements according to the density levels of the individual pattern elements of the test pattern.

15. The focus adjustment device for the optical writing unit according to claim 8, wherein said image former forms binary pattern elements made of different numbers of pixels according to the varying density levels of the individual pattern elements of the test pattern.

16. The focus adjustment device for the optical writing unit according to claim 8, wherein said adjustment mechanism varies the position of the optical writing unit to an offset position closer to or farther away from the image-carrying member than a position where the focal point of the light emitted from the individual light-emitting elements is expected to coincide with the surface of the image-carrying member before execution of the image forming operation by said image former.

17. An image forming apparatus comprising a focus adjustment device for performing electrophotographic image forming operation by projecting light modulated by image data onto an image-carrying member from an optical writing unit of which position relative to a surface of the image-carrying member has been adjusted by means of said focus adjustment device which includes:

a memory for storing data on a test pattern, the test pattern including:

multiple uninterrupted pattern elements of gradually varying density levels corresponding to different amounts of adjustment extending all along a main scanning direction in an image forming area; and adjustment quantity information denoting the amount of adjustment corresponding to the density levels of the pattern elements;

an image former including said optical writing unit having first and second ends for performing image forming operation to form the test pattern stored in the memory; and an adjustment mechanism for separately adjusting the position of each end of said optical writing unit relative to a surface of an image-carrying member in a direction of light emitted from multiple light-emitting elements corresponding to pixels arranged along a main scanning direction over said image forming area in such a manner that said optical writing unit is positioned at a proper distance from, and parallel to, said surface of said image-carrying member according to said amounts of adjustment according to said adjustment quantity information.

18. The image forming apparatus according to claim 17 further comprising an image reader for reading an original image, and said focus adjustment device further including a controller for determining the amount of adjustment of the optical writing unit based on the test pattern which is formed on a printing medium by the image former of said focus adjustment device and read by said image reader.

* * * * *